US007305978B2

(12) United States Patent
Osanai

(10) Patent No.: US 7,305,978 B2
(45) Date of Patent: Dec. 11, 2007

(54) VAPORIZED FUEL PURGE SYSTEM

(75) Inventor: Akinori Osanai, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/518,308

(22) Filed: Sep. 11, 2006

(65) Prior Publication Data

US 2007/0062505 A1 Mar. 22, 2007

(30) Foreign Application Priority Data

Sep. 20, 2005 (JP) ..... 2005-271320

(51) Int. Cl.
*F02M 25/08* (2006.01)
*F02D 41/14* (2006.01)

(52) U.S. Cl. ..... 123/686; 123/520; 123/698

(58) Field of Classification Search ..... 123/520, 123/685, 686, 689, 698
See application file for complete search history.

(56) References Cited

U.S. PATENT DOCUMENTS 4,763,634 A * 8/1988 Morozumi ..... 123/520
5,529,047 A * 6/1996 Aota et al. ..... 123/698
5,690,086 A * 11/1997 Kawano et al. ..... 123/674
5,778,865 A * 7/1998 Tachibana et al. ..... 123/675
6,079,393 A * 6/2000 Tsutsumi et al. ..... 123/478
6,708,682 B2 3/2004 Osanai

FOREIGN PATENT DOCUMENTS

JP A 7-259615 10/1995

* cited by examiner

*Primary Examiner*—T. M Argenbright
(74) *Attorney, Agent, or Firm*—Kenyon & Kenyon LLP

(57) ABSTRACT

A feedback correction coeficient used to perform feedback-control of the fuel injection amount based on the air-fuel ratio of exhaust gas is calculated. A concentration updating based value is set based on the deviation of the oscillation center of the feedback correction coefficiect, and a vapor concentration correction coefficient corresponding to the fuel concentration of purge gas is updated using the concentration updating base value. During the period where the fuel concentration of purge gas is expected to sharply decrease, the concentration updating base value is increased.

18 Claims, 14 Drawing Sheets

VAPORIZED FUEL PURGE SYSTEM

INCORPORATION BY REFERENCE

The disclosure of Japanese Patent Application No. 2005-271320 filed on Sep. 20, 2005 including the specification, drawings and abstract is incorporated herein by reference in its entirety.

BACKGROUND OF THE INVENTION

1. Field of the Invention

The invention relates to a vaporized fuel purge system, and particularly, to a vaporized fuel purge system suitable for purging vaporized fuel generated within a fuel tank of a vehicle.

2. Description of the Related Art

Patent Application Publication No. H7-259615 discloses the device that adsorbs vaporized fuel generated in the fuel tank so as to be held in the canister, and purges the vaporized fuel into the intake passage during operation of the internal combustion engine. In order to constantly maintain the control accuracy of the air-fuel ratio in the aforementioned device, the fuel injection amount is required to be reduced during purging by the amount corresponding to that of the vaporized fuel to be supplied.

The aforementioned device includes an oxygen sensor disposed in the exhaust passage of the internal combustion engine to satisfy the aforementioned requirement. The oxygen sensor generates a signal indicating the exhaust air-fuel ratio being either rich or lean.

The device then calculates the feedback correction coefficient FAF for correcting the fuel injection amount based on the output of the oxygen sensor. Specifically, the fuel injection amount is increased as the FAF becomes larger, and is decreased as the FAF becomes smaller.

The feedback correction coefficient FAF is updated in an increasing direction while the output of the oxygen sensor indicates lean, and is updated in a decreasing direction while the output of the oxygen sensor indicates rich. If the exhaust air-fuel ratio is lean, the fuel injection amount is gradually increased toward a theoretical air-fuel ratio. If it is rich, the fuel injection amount is gradually decreased toward the theoretical air-fuel ratio.

Purge gas of the vaporized fuel supplied into the intake air passage influences the exhaust air-fuel ratio. For example, if the purge gas is fuel-rich, the exhaust air-fuel ratio will shift to rich. Then the feedback correction coefficient FAF is updated in the decreasing direction to prevent the shifting of the air-fuel ratio to rich. As such, the effect of the fuel-richness of the purge gas is absorbed by the FAF, whereby the exhaust air-fuel ratio is maintained around the theoretical air-fuel ratio.

In the aforementioned case, the feedback correction coefficient FAF becomes smaller than a reference value (for example, 1.0) by the value corresponding to the fuel-rich level of purge gas. Therefore, it is possible to estimate the fuel-rich level of the purge gas based on the difference between an actual value of the FAF and the reference value. Likewise, if the purge gas is fuel-lean, the feedback correction coefficient FAF becomes larger than the reference value by the value corresponding to the fuel-lean level of purge gas. It is also possible to estimate the fuel-lean level of the purge gas based on the difference between the actual value of the FAF and the reference value.

In the aforementioned device, the fuel concentration of purge gas is learned in order to reduce the fuel injection amount by the amount of the supplied vaporized fuel. Specifically, when the feedback correction coefficient FAF becomes larger than the reference value by 2% or more during purging of vaporized fuel, it is considered that the current fuel concentration is excessively low. The fuel concentration is then updated to rich by a specified update value. Meanwhile, when the feedback correction coefficient FAF becomes smaller than the reference value by 2% or more, it is considered that the current fuel concentration is excessively high. The fuel concentration, thus, is updated to lean by a specified update value.

In the aforementioned process, the fuel concentration of purge gas can be correctly learned. If the fuel injection amount is reduced based on the correctly learned fuel concentration, the influence of the vaporized fuel may be eliminated. Accordingly, the accuracy in controlling the air-fuel ratio may be maintained during purging of the vaporized fuel.

The fuel concentration of purge gas cannot be maintained constant during operation of the internal combustion engine. For example, when the amount of the fuel adsorbed in the canister has decreased to a certain level during purging of vaporized fuel, the fuel concentration of purge gas decreases sharply. Generally, the learned value of the fuel concentration of purge gas reflects changes in the fuel concentration of purge gas via the feedback correction coefficient FAF. However, if the fuel concentration changes sharply, the learned value is likely to largely deviate from the actual fuel concentration of purge gas.

In consideration of the above-described problem, the foregoing related-art device changes the update value of the fuel concentration of purge gas to be large in response to a sharp change in the fuel concentration of purge gas. Such a process makes it possible to update the learned value of the fuel concentration of purge gas so as to follow sharp changes in the actual fuel concentration. Accordingly, the device is capable of maintaining the accuracy of the air-fuel ratio control in spite of sharp changes in the fuel concentration of purge gas.

The aforementioned device is designed to update the fuel concentration of purge gas with predetermined update values. That is, the fuel concentration is always updated using the predetermined update values irrespective of how the learned value has been deviating from the actual fuel concentration of purge gas in each case.

This related-art device, therefore, may cause the problems to be described below. Firstly, when the learned value largely deviates from the actual fuel concentration of the purge gas, the fuel concentration is first updated, repeatedly, using a predetermined small update value. If a sharp change in the fuel concentration is then detected, the update value is changed to a predetermined large update value, with which the fuel concentration is further updated. In this case, the learned value of the fuel concentration may fail to timely approximate the actual fuel concentration.

Secondly, after detection of the sharp change in the fuel concentration, even if the deviation of the learned value from the actual fuel concentration becomes small, the learned value is continuously updated with the predetermined large update value until the determination of the sharp change in the fuel concentration is canceled. Thus, there may be the case that the learned value of the fuel concentration exceeds the actual fuel concentration, resulting in overshooting. Thus, the aforementioned related-art device has difficulties in learning the fuel concentration of purge gas timely and accurately.

SUMMARY OF THE INVENTION

In view of the above, the invention provides a vaporized fuel purge system and a fuel injection amount calculating method for an internal combustion engine.

A first aspect of the invention relates to a vaporized fuel purge system including: a fuel injection valve that injects a fuel in an internal combustion engine; an exhaust gas sensor that generates an output indicative of an exhaust air-fuel ratio in the internal combustion engine; an FAF calculation device that calculates, based on the output of the exhaust gas sensor, a feedback correction coefficient applied to a fuel injection amount so that the exhaust air-fuel ratio matches a target air-fuel ratio; a canister that adsorbs a vaporized fuel produced in a fuel tank; a purge mechanism that allows a purge gas that contains the vaporized fuel to flow from the canister into the internal combustion engine; a sharp-change-condition detecting device that detects a sharp-change condition in which a fuel concentration of the purge gas changes at a rate higher than a reference rate; a concentration updating base value setting device that sets a concentration updating base value based on the feedback correction coefficient by a predetermined process; a process changing device that changes the predetermined process such that the concentration updating base value is made larger in the sharp-change condition than in a non-sharp-change condition; a fuel concentration updating device that updates a fuel concentration of the purge gas using the concentration updating base value; a purge correction coefficient calculation device that calculates a purge correction coefficient that is used to eliminate an influence of the vaporized fuel based on the fuel concentration of the purge gas; and a fuel injection amount calculation device that calculates a final fuel injection amount by reflecting the feedback correction coefficient and the purge correction coefficient on a basic fuel injection amount.

In this case, the concentration update base value is set based on the feedback correction coefficient for correcting the exhaust air-fuel ratio to the target air-fuel ratio so as to update the fuel concentration of purge gas. The feedback correction coefficient reflects the deviation of the exhaust air-fuel ratio from the target air-fuel ratio, that is, the deviation of the learned value from the actual fuel concentration of purge gas during purging. According to the invention, the fuel concentration of purge gas is updated based on the deviation of the learned value from the actual value of the fuel concentration. Also, in the sharp-change condition in the fuel concentration of purge gas, the concentration update base value is made larger than in a non-sharp-change condition. Thus, the invention makes it possible to constantly and promptly converge the learned value of the fuel concentration of purge gas to the actual fuel concentration value.

The above system may further include a dead band determination device that determines whether the concentration updating base value is out of a dead band; an update permission device that permits execution of the updating of the fuel concentration of the purge gas only when the concentration updating base value is out of the dead band; and a dead band changing device that, in the sharp-change condition, changes one of an upper threshold value and a lower threshold value of the dead band, which is in a direction in which the concentration updating value is changing, towards the other of the upper and the lower threshold values.

In this case, the update of the fuel concentration of the purge gas is allowed only when the concentration update base value that has been set based on the feedback correction coefficient deviates is out of the dead band. That is, in the sharp-change condition, upper and lower threshold values of the dead band are changed so as to cause the concentration update base value to easily deviate from the dead band. Accordingly, the fuel concentration of the purge gas is more likely to be updated in response to a sharp change in the fuel concentration, which enables the updating to more accurately and timely reflect changes in the actual fuel concentration of the purge gas.

In the above system, the dead band changing device may change, in the sharp-change condition, the other of the upper and the lower threshold values in a same direction as that of the one of the upper and the lower threshold values.

The above structure allows the upper and lower threshold values of the dead band to shift in the same direction in response to a sharp change in the fuel concentration. In this case, the width of the dead band is hardly narrowed, thus maintaining its hunting prevention function.

In the above system, the sharp change detection device may include a total purge amount correlation value detection device that detects a total purge amount correlation value correlated with a total purge amount of the vaporized fuel, and the sharp-change condition may be detected when the total purge amount correlation value corresponds to a predetermined sharp-change value.

In this case, the sharp-change condition may be detected based on the parameter correlated with the total purge amount. Note that the fuel concentration of purge gas sharply decreases when the amount of the fuel within the canister becomes small as the purging proceeds and the timing when the fuel concentration sharply decreases is correlated with the total purge amount of the vaporized fuel. So, according to the above structure, it is possible to appropriately estimate when the fuel concentration sharply decreases.

The above system may further include: an engine temperature correlation value detection device that detects an engine temperature correlation value correlated with a temperature of the internal combustion engine; a warm start detection device that detects a warm start of the internal combustion engine if the engine temperature correlation value is higher than a reference value upon starting; and a sharp-change condition detection prohibiting device that prohibits the detecting of the sharp change condition when a warm start of the internal combustion engine is detected.

In this case, a warm start of the internal combustion engine is detected based on the parameter correlated with the engine temperature upon start of the engine, and when a warm start is thus detected, the detecting of the sharp-change condition is prohibited. Note that since a large amount of the vaporized fuel is generated within the fuel tank when the engine has been warm-started, the fuel concentration of purge gas hardly decreases sharply during purging. According to the above structure, therefore, it is possible to effectively prevent execution of the process that copes with a sharp change in the fuel concentration of purging gas when such a sharp change does not actually occur.

The above system may further include: an engine temperature correlation value detection device that detects an engine temperature correlation value correlated with an temperature of the internal combustion engine; and a sharp change condition detection canceling device that cancels the detection of the sharp change condition when the engine temperature correlation value exceeds a reference value.

In this case, the detection of the sharp-change condition is canceled when it is determined that the engine temperature has been sufficiently increased after start of the internal combustion engine. If the engine temperature increases sufficiently, the vaporized fuel amount generated within the fuel tank becomes large, and therefore, the fuel concentration of purge gas is unlikely to decrease. According to the above structure, therefore, it is possible to effectively prevent execution of the process that copes with a sharp change in the fuel concentration of purging gas when such a sharp change does not actually occur.

The above system may further include a sharp change condition detection canceling device that cancels the detection of the sharp change condition when the total purge amount correlation value exceeds a reference value.

In this case, the detection of the sharp-change condition is canceled when the total purge amount reaches a sufficient level. As the total purge amount increases, the fuel concentration of the purge gas converges to a specific level. That is, the fuel concentration of purge gas is unlikely to decrease after the total purge amount has reached the sufficient level. According to the above structure, therefore, it is possible to effectively prevent execution of the process that copes with a sharp change in the fuel concentration of purging gas when such a sharp change does not actually occur.

The above system may further include: an engine temperature correlation value detection device that detects an engine temperature correlation value correlated with a temperature of the internal combustion engine, wherein the fuel concentration updating device includes an initial value setting device that sets an initial value of the fuel concentration of the purge gas higher as the engine temperature correlation value upon start of the internal combustion engine becomes higher.

In this case, the initial value of the purge correction coefficient is set on the assumption that the fuel concentration of purge gas is higher when the engine temperature upon start is higher. Note that, the higher the temperature, the more likely the fuel adsorbed within the canister will be purged and the fuel within the fuel tank will be vaporized. That is, the higher the engine temperature upon its start, the higher the concentration of the purge gas generated immediately after start of purging will be. According to the above structure, therefore, it is possible to set the initial value of the fuel concentration of purging gas so that it more precisely corresponds to the actual fuel concentration of the purging gas.

A second aspect of the invention relates to a vaporized fuel purge system, including: a fuel injector that injects fuel in an internal combustion engine; a vaporized fuel trap that traps fuel vaporized within a fuel tank; a purge unit that supplies the internal combustion engine with a purge gas containing fuel released from the vaporized fuel trap; and a fuel injection amount calculator. The fuel injection amount calculator is configured to: identify a sharp-change period in which a fuel concentration of the purge gas is expected to change sharply during the supplying of the purge gas; based on a first parameter correlated with a difference between an actual air-fuel ratio of an exhaust gas of the internal combustion engine and a target air-fuel ratio of the exhaust gas, calculate, during the supplying of the purge gas, an updating amount of a second parameter correlated with the fuel concentration of the purge gas; update the second parameter by changing it by the calculated updating amount; and calculate a target amount of fuel to be injected from a fuel injector using the first parameter and the second parameter. During the sharp-change period, the fuel injection amount calculator performs the calculation of the updating amount using a calculation method that is different from the one used during other period, so as for the updating amount to be larger during the sharp-change period than during the other period.

A third aspect of the invention relates to a fuel injection amount calculating method for an internal combustion engine to which a purge gas is supplied from a vaporized fuel trap that traps fuel vaporized in a fuel tank. The method includes: identifying a sharp-change period in which a fuel concentration of the purge gas is expected to change sharply during the supplying of the purge gas; based on a first parameter correlated with a difference between an actual air-fuel ratio of an exhaust gas of the internal combustion engine and a target air-fuel ratio of the exhaust gas, calculating, during the supplying of the purge gas, an updating amount of a second parameter correlated with the fuel concentration of the purge gas; updating the second parameter by changing it by the calculated updating amount; and calculating a target amount of fuel to be injected from a fuel injector using the first parameter and the second parameter. During the sharp-change period, the calculation of the updating amount is performed using a calculation method that is different from the one used during other period, so as for the updating amount to be larger during the sharp-change period than during the other period.

DETAILED DESCRIPTION OF THE PREFERRED EMBODIMENTS

First Embodiment

Figure 1:
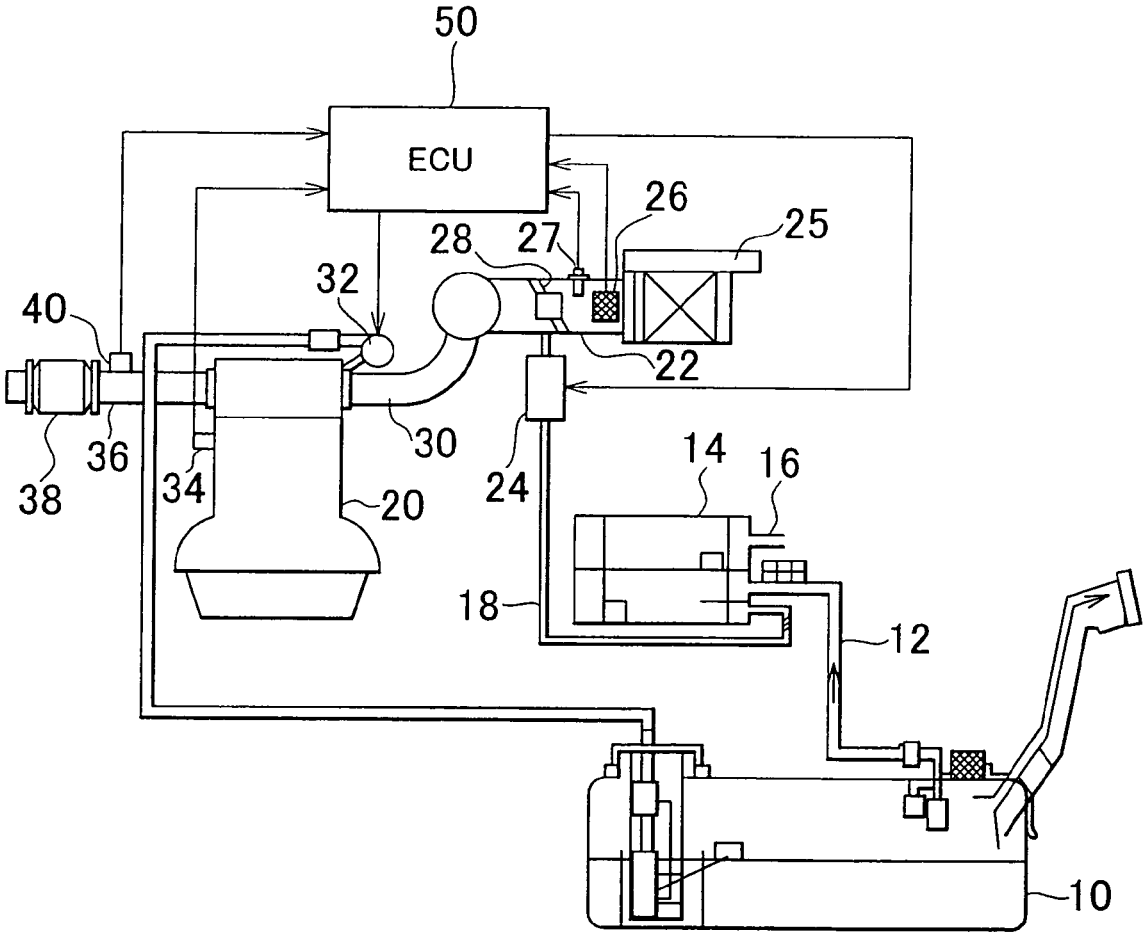
FIG. 1 is an explanatory view with respect to the structure of a first embodiment of the invention.

FIG. 1 shows a structure of a first embodiment of the invention. A vaporized fuel purge system includes a fuel tank 10 communicated with a canister 14 through a vapor passage 12. The canister 14 is provided with an air inlet 16, and communicated with an intake air passage 22 of an internal combustion engine 20 via a purge passage 18. The canister 14 contains activated carbon for adsorbing the vaporized fuel generated within the fuel tank 10.

The purge passage 18 is provided with a purge control valve 24 which controls a flow rate of gas flowing therethrough. The purge control valve 24 is duty controlled to a desired opening degree.

The intake air passage 22 is provided with an air cleaner 25 at its one end, and both an airflow meter 26 for detecting an intake air amount Ga and an intake air temperature sensor 27 for detecting an intake air temperature THA are provided downstream of the air cleaner 25. The intake air passage 22 is also provided with a throttle valve 28 downstream of the airflow meter 26. The purge passage 18 is communicated with the intake passage 22 downstream of the throttle valve 28.

The intake passage 22 is connected to intake ports of the respective cylinders via an intake manifold 30. The internal combustion engine 20 is provided with a fuel injection valve 32 through which the fuel is injected into each of the intake ports, respectively.

The internal combustion engine 20 includes a water temperature sensor 34 for detecting a cooling water temperature THW installed therein. The internal combustion engine 20 is communicated with an exhaust passage 36 provided with a catalyst 38 for purifying the exhaust gas. An oxygen sensor 40 is provided upstream of the catalyst 38 for generating a signal indicating either a rich state or a lean state of exhaust air-fuel ratio.

The system according to the embodiment includes an ECU (Electronic Control Unit) 50 as a control unit for the system, and is capable of activating various actuators such as a purge control valve 24 and the fuel injection valve 32 based on output signals of various sensors as described above, for example, the airflow meter 26, the oxygen sensor 40 and the like.

The fuel tank 10 contains gas including the vaporized fuel which flows from the vapor passage 12 into the canister 14 in response to further generation of the vaporized fuel due to an increase in the tank temperature, or during refueling. The vaporized fuel flowing from the fuel tank 10 is temporarily adsorbed in the canister 14, and then purged into the intake passage 22 during operation of the internal combustion engine 20.

Figure 2:
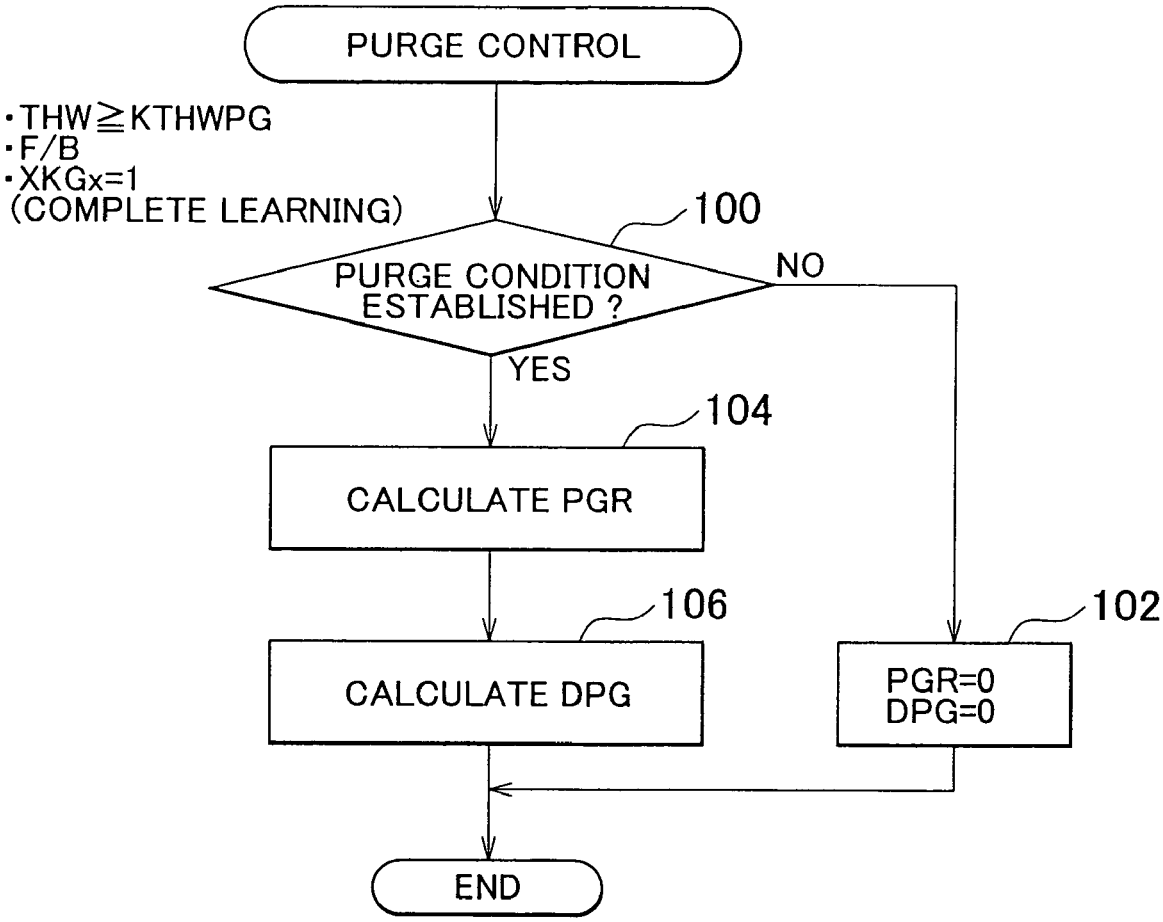
FIG. 2 is a flowchart of a control routine for executing a purge control in the system according to the first embodiment.

FIG. 2 is a flowchart representing a control routine executed by the ECU 50 for purging the vaporized fuel within the canister 14 during operation of the internal combustion engine 20. Referring to the routine of the flowchart shown in FIG. 2, first in step 100, it is determined whether a vaporized fuel purge condition has been established. The following conditions may be regarded as the purge condition.

(1) The internal combustion engine 20 has been sufficiently warmed up.

(2) The air-fuel ratio feedback control based on the output of the oxygen sensor 40 has been started.

(3) The learned value KG for eliminating variations in the air-fuel ratio due to aging or individual variability of the internal combustion engine 20 has been obtained.

If it is determined that the purge condition is not established in step 100, the target purge rate PGR is set to 0, and the duty rate DPG for driving the purge control valve 24 is also set to 0 in step 102. The purge rate PGR represents the ratio of the flow rate QPG of purge gas to the intake air amount Ga in percentage, which is expressed as (QPG/Ga)×100.

Because the drive duty rate DPG is set to 0 in step S102, the purge control valve 24 is maintained closed. In this case, the communication between the canister 14 and the intake passage 22 remains blocked and purging of vaporized fuel is not carried out.

If it is determined in step 100 that the purge condition has been established, conversely, the routine proceeds to step 104 where the target purge rate PGR is calculated by following a predetermined process. Then in step 106, the drive duty rate DPG is determined to achieve the target purge rate PGR according to the operation state of the internal combustion engine 20, and the like.

After step 106, the purge control valve 24 is controlled with the drive duty rate DPG calculated therein. As a result, the vaporized fuel in the canister 14 is purged at the desired purge rate PGR.

The aforementioned purge process is known as disclosed in, for example, patent application Publication No. 2003-83135. As such process is not the essential part of the invention, further explanation with respect to the process will be omitted.

The system according to the embodiment of the invention starts purging the vaporized fuel within the canister 14 upon establishment of the purge condition after start-up of the internal combustion engine 20. The thus purged vaporized fuel is supplied into the respective cylinders in the internal combustion engine 20 for combustion. The system according to the embodiment of the invention, thus, effectively prevents the unburned vaporized fuel generated within the fuel tank 10 from being discharged into atmosphere.

Figure 3:
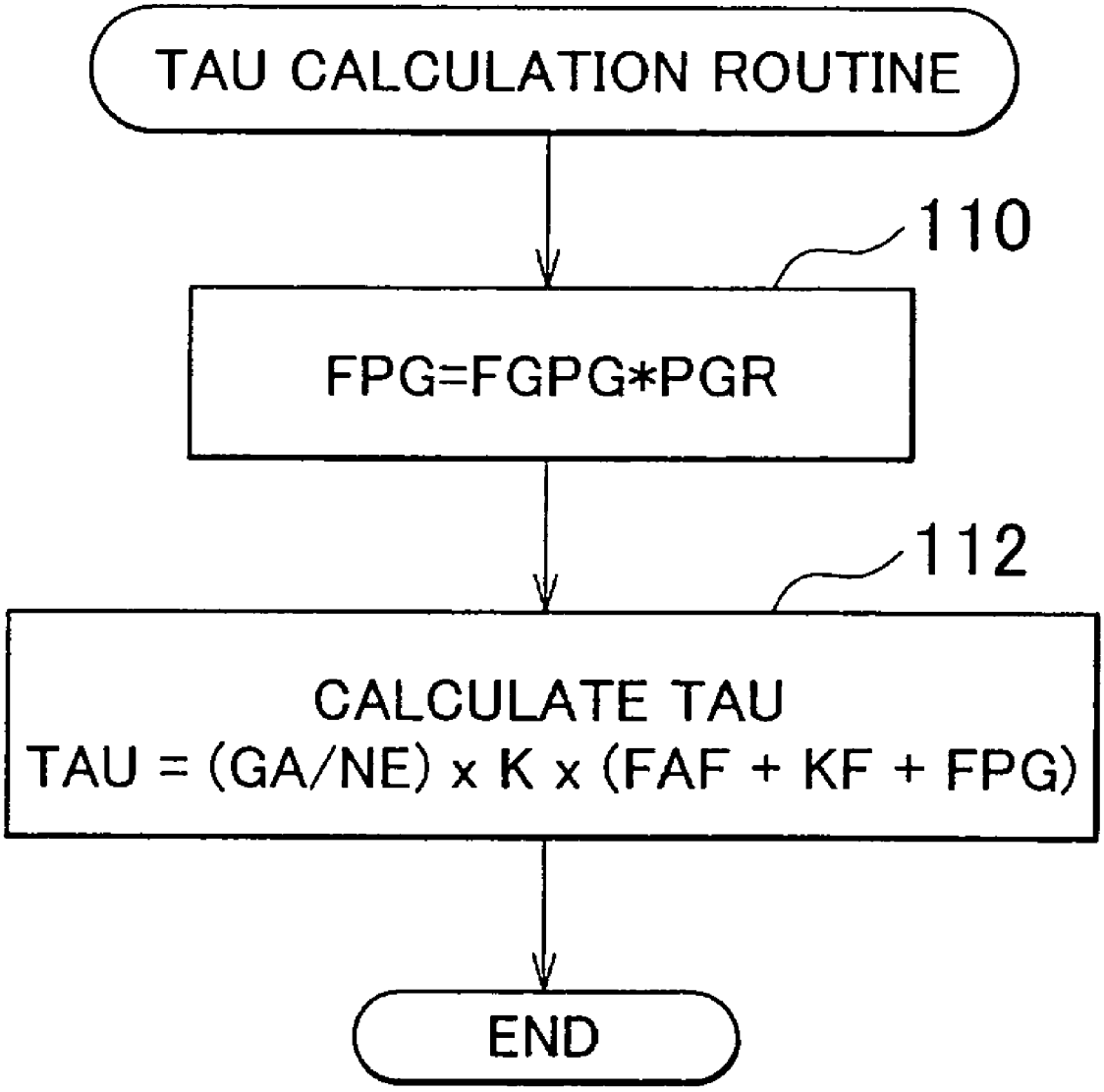
FIG. 3 is a flowchart of a control routine for calculating a fuel injection time TAU in the system according to the first embodiment.

Referring to FIGS. 3 and 4, the process for calculating the fuel injection time TAU executed by the vaporized fuel purge system according to the embodiment will be described. In the embodiment, the fuel is supplied to the fuel injection valve 32 at a predetermined pressure. The amount of the fuel injected through the fuel injection valve 32 corresponds to the time period for which the fuel injection valve 32 is opened. The ECU 50 calculates the fuel injection time TAU for obtaining the desired fuel injection amount and controls the fuel injection valve 32 based on the calculated TAU.

FIG. 3 is a flowchart of the routine executed by the ECU 50 for calculating the fuel injection time TAU. In step 110 of the routine, a purge correction coefficient FPG is calculated using the following expression:

$$FPG=FGPG\times PGR \quad \ldots (1)$$

where FGPG is a vapor concentration correction coefficient correlated with the fuel concentration of the purge gas.

The fuel injection time TAU is calculated such that the air-fuel ratio of the air-fuel mixture introduced into the internal combustion engine 20 equals a target air-fuel ratio. If the air-fuel ratio of the purge gas that contains vaporized fuel is equal to the target air-fuel ratio, the target air-fuel ratio can be achieved by simply setting the ratio of the fuel injection amount to the intake air amount Ga, which is detected by the airflow meter 26, to the target air-fuel ratio. However, when the purge gas is fuel-rich, the air-fuel ratio of the mixture cannot be made equal to the target air-fuel ratio unless the fuel injection amount is reduced by the amount needed to eliminate the influence of the fuel-rich purge gas. Likewise, when the purge gas is fuel-lean, the air-fuel ratio of the mixture cannot be made equal to the target air-fuel ratio unless the fuel injection amount is appropriately increased.

The purge correction coefficient FPG derived from the expression (1) represents the amount of correction applied to the fuel injection time TAU so as to eliminate the influence of the purge gas. More specifically, the vapor concentration correction coefficient FGPG represents a physical correction amount that is applied to the fuel injection time TAU per 1% of the purge rate PGR. The vapor concentration correction coefficient FGPG is a negative value when the fuel concentration of purge gas is high (the purge gas is fuel-rich), and decreases, i.e., becomes a larger negative value, as the fuel concentration of the purge gas increases. On the other hand, it is a positive value when the fuel concentration of the purge gas is low (the purge gas is fuel-lean), and increases as the fuel concentration of the purge gas decreases. This means that, as well as being the physical correction amount to be applied to the TAU per 1% of PGR, the vapor concentration correction coefficient FGPG can also be used as a value indicating the fuel concentration of the purge gas.

Because, as described above, the vapor concentration correction coefficient FGPG is the correction amount to be applied to the fuel injection time TAU per 1% of the purge rate PGR, the correction amount FPG, which is applied to the fuel injection time TAU while purging is performed at a certain purge rate PGR, is obtained by multiplying the correction amount FGPG by that purge rate PGR. As such, with the expression (1), the correction amount FPG for the fuel injection time TAU can be properly calculated so as to offset the influence of vaporized fuel purged at the purge rate PGR.

Referring to the flowchart of FIG. 3, the fuel injection time TAU is derived from the expression (2) in step 112:

$$TAU=(Ga/Ne)\times K\times(FAF+KF+FPG) \quad \ldots (2)$$

where Ne represents an engine speed, K an injection coefficient, FAF a feedback correction coefficient (to be described later), and KF the sum of various increasing and decreasing correction coefficients (including the foregoing learned value KG).

According to the expression (2), the intake air amount Ga is divided by the engine speed Ne, and the result is multiplied by the injection coefficient K to obtain the basic fuel injection time. The basic fuel injection time is corrected with the feedback correction coefficient FAF and the purge correction coefficient FPG so as to accurately obtain the fuel injection time TAU for realizing the desired air-fuel ratio.

Figures 4A, 4B, 4C:
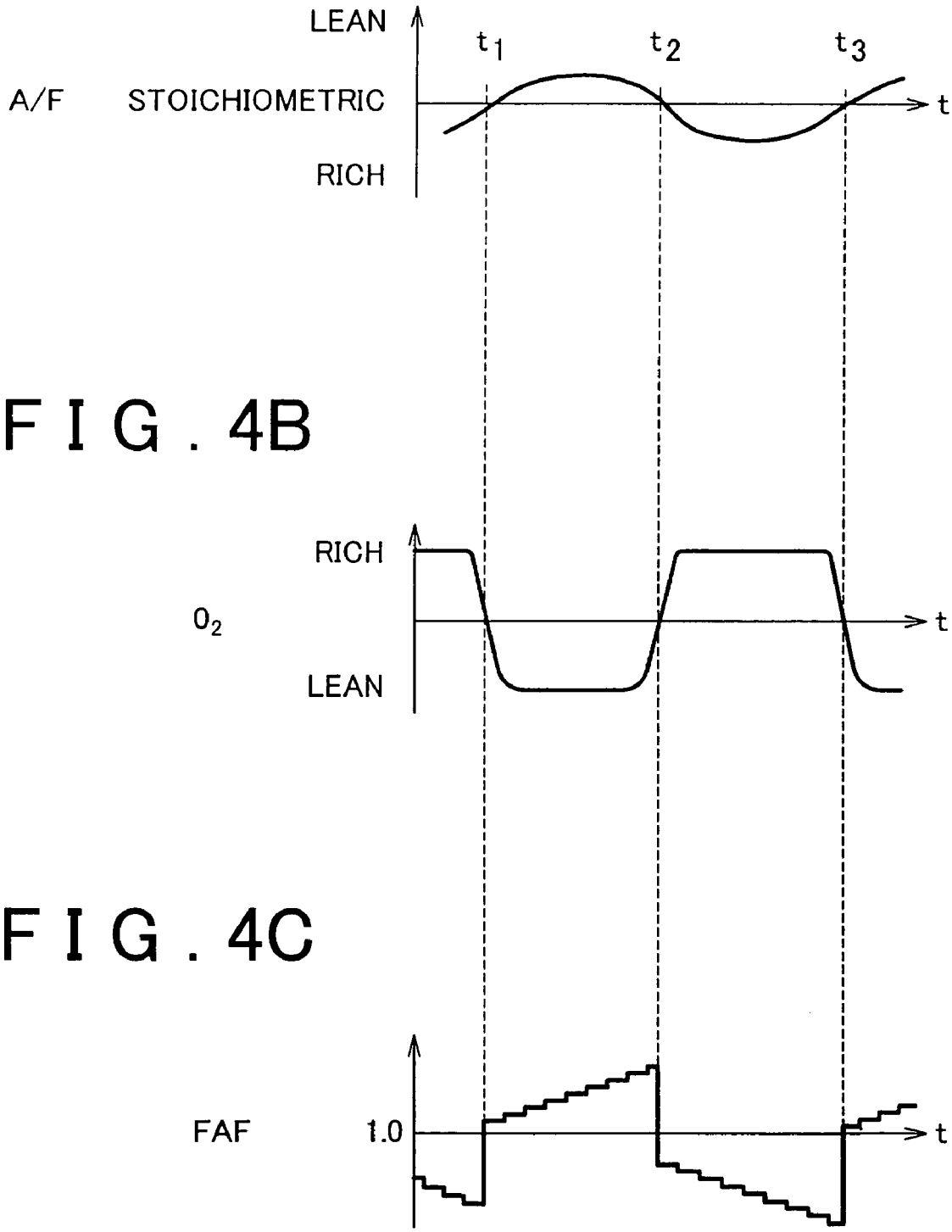
FIGS. 4A to 4C show timing charts for explaining the updating process of the feedback correction coefficient FAF used in the routine shown in FIG. 3.

FIGS. 4A to 4C are timing charts used for explaining the process for calculating the feedback correction coefficient FAF. More specifically, FIG. 4A shows changes in the exhaust air-fuel ratio upstream of the catalyst 38. FIG. 4B shows changes in the output of the oxygen sensor 40. FIG. 4C shows changes in the feedback coefficient FAF.

Referring to FIGS. 4A and 4B, when the exhaust air-fuel ratio is fuel-rich, the oxygen sensor 40 produces a rich output (before t1, from t2 to t3). During these periods, the ECU 50 updates the feedback coefficient FAF by decrementing it by small steps, as shown in FIG. 4C. According to the expression (2), the fuel injection time TAU decreases as the feedback correction coefficient FAF decreases. While the oxygen sensor 40 is producing the rich output, the fuel injection amount is gradually reduced, so that the air-fuel ratio of exhaust gas becomes lean (t1 and t3).

When the exhaust air-fuel ratio shifts from rich to lean, the output of the oxygen sensor 40 reverses from rich to lean. In response to this reversal of the output of the oxygen sensor 40, the ECU 50 first increases the feedback coefficient FAF by a large step, and then by small steps. This small-step-increase continues so long as the oxygen sensor 40 maintains the lean output. When the FAF is thus increased, the fuel injection amount increases accordingly, so that the exhaust air-fuel ratio shifts from lean to rich (t2).

In response to the shifting of the air-fuel ratio of exhaust gas, the ECU 50 starts updating the feedback coefficient FAF in a decreasing direction. This procedure is repeatedly executed where the feedback coefficient FAF repeatedly increases and decreases in accordance with the exhaust air-fuel ratio so as to maintain the exhaust air-fuel ratio around the theoretical air-fuel ratio.

In the embodiment, the vapor concentration correction coefficient FGPG is calculated so as to eliminate the influence of purged vaporized fuel (see expression (1)). The following expression (3) is used in a basic method for calculating the value of the vapor concentration correction coefficient FGPG:

$$FGPG=FGPG+\{(FAFSM-1)/PGR\}/2 \quad \ldots (3)$$

where FGPG on the left represents the value after updating, and FGPG on the right represents the value before updating. FAFSM on the right represents the smoothed value of the feedback correction coefficient FAF, which corresponds to the center about which the value of FAF oscillates.

The fuel concentration of the purge gas is unknown when starting purging of vaporized fuel. Accordingly, an appropriate initial value is given to the FGPG on the right of the expression. The vapor concentration correction coefficient FGPG is, as mentioned above, the correction amount applied to the injection time TAU per 1% of the purge rate PGR. Therefore, when the purge gas is at the theoretical air-fuel ratio, no correction is required regarding the purging. In view of this, it is appropriate to set the FGPG on the right of the expression to 0. In this embodiment, therefore, the FGPG on the right of the expression is set to 0 as its initial value when starting the purging.

As described above, purging of vaporized fuel starts after obtaining the learned value KG (see step 100). The learned value KG is the correction coefficient to absorb deviations of the air-fuel ratio caused by changes in characteristics of the internal combustion engine 20 due to aging or variability among individual engines. Before learning of the learned value KG, the influence of such deviations of the air-fuel ratio is absorbed by the feedback correction coefficient FAF as described below.

In the case where the air-fuel ratio shows a tendency to be biased to rich before completion of learning of the learned value KG, the oscillation center FAFSM of the feedback correction coefficient FAF will shift below the reference value 1.0 so as to offset such bias. Conversely, in the case where the air-fuel ratio shows a tendency to be biased to lean, the oscillation center FAFSM of the feedback correction coefficient FAF will shift above the reference value 1.0 so as to offset such bias. Thus, after learning of the learned value KG, the feedback correction coefficient FAF oscillates about the reference value 1.0.

If the vapor concentration correction coefficient FGPG is equal to FGPG0 that indicates the actual fuel concentration of the purge gas when starting purging of vaporized fuel after learning of the learned value KG, the influence of the purge gas may be eliminated by correcting the fuel injection time TAU with the purge correction coefficient FPG. In this case, the oscillation center FAFSM of the feedback correction coefficient FAF remains 1.0. Meanwhile, if the FGPG is not equal to the FGPG0, the oscillation center FAFSM of the feedback correction coefficient FAF will shift in the direction to offset the difference therebetween.

For example, assuming that the vapor concentration correction coefficient FGPG is set to 0 as its initial value when the purge gas is actually fuel-rich, and the value of FGPG0 that correctly indicates the state of that fuel-rich purge gas is −0.01, the amount of correction made to the fuel injection time TAU using the purge correction coefficient FPG will be insufficient by the amount corresponding to the value obtained by multiplying the difference between the FGPG0 and FGPG that is, −0.01 (ΔFGPG=FGPG0−FGPG=−0.01) by the purge rate PGR (10%, for example), that is, ΔFGPG×PGR=−0.1. In this case, the oscillation center FAFSM of the feedback correction coefficient FAF will shift from the reference value 1.0 to 0.9, i.e., by the aforementioned insufficiency, that is, −0.1.

In other words, in the case where the oscillation center FAFSM of the feedback correction coefficient FAF deviates from the reference value 1.0 after the purging of the vaporized fuel starts, the deviation, that is, ΔFAFSM=FAFSM−1.0 may be obtained by multiplying the deviation ΔFGPG=FGPG0−FGPG by the purge rate PGR as in the following expression:

$$\Delta FAFSM = \Delta FGPG \times PGR \quad \ldots (4)$$

Therefore, the deviation ΔFGPG may be obtained by dividing the difference between the FAFSM and the reference value 1.0, that is, ΔFAFSM=FAFSM−1.0 by the purge rate PGR as in the following expression:

$$\Delta FGPG = \Delta FAFSM / PGR \quad (5)$$

Then, by adding the obtained deviation ΔFGPG to the current vapor concentration correction coefficient FGPG the value of FGPG0, which correctly indicates the actual fuel concentration, is obtained as shown in the following expression:

$$\begin{aligned} FGPG0 &= FGPG + \Delta FGPG \quad (6) \\ &= FGPG + (FAFSM - 1)/PGR. \end{aligned}$$

In the expression (3), {(FAFSM−1)/PGR}/2 on the right represents the value obtained by dividing the aforementioned deviation ΔFGPG by 2. That is, the expression (3) is used to reflect half of the difference ΔFGPG to the value of FGPG in each cycle. In this way, with the expressions as described above, it is possible to update the vapor concentration correction coefficient FGPG by using the deviation ΔFGPG, which is superimposed on the vapor concentration correction coefficient FGPG as a concentration updating value. Thus, the aforementioned process makes it possible to converge the vapor concentration correction coefficient FGPG to the FPGP0 corresponding to the actual fuel concentration quickly and appropriately. This updating process using the expression (3) will be referred to as the "basic updating process".

Figure 5A:
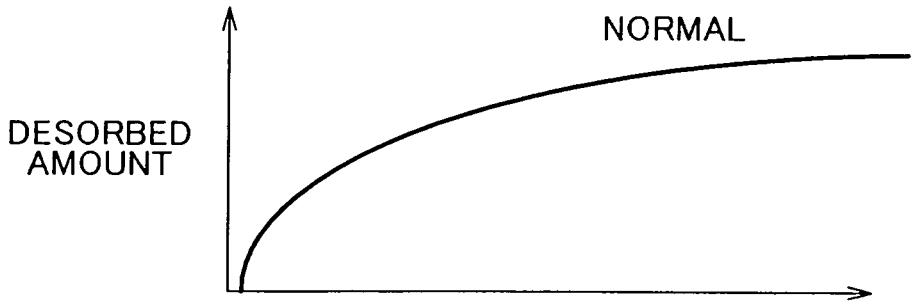
FIGS. 5A to 5C show timing charts for explaining the problem that resides in the basic process for updating the vapor concentration correction coefficient FGPG used in the routine shown in FIG. 3.
Figure 5B:
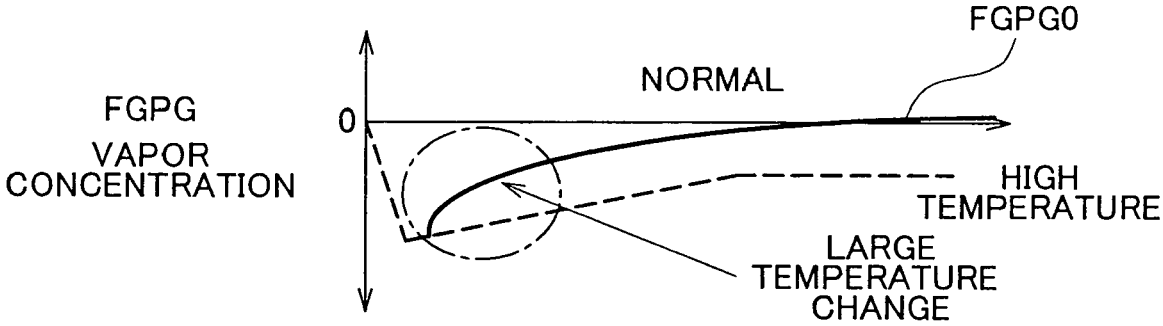
Figure 5C:
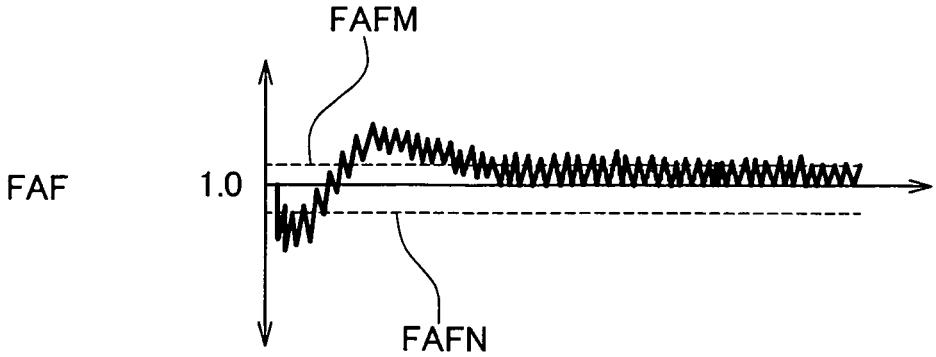

FIGS. 5A to 5C are timing charts used for explaining the problem found in the basic updating process as described above. Specifically, FIG. 5A shows changes in the total amount of purge gas desorbed from the canister 14. FIG. 5B shows changes in the vapor concentration correction coefficient FGPG calculated with the basic updating process (broken line), and changes in the value corresponding to the actual fuel concentration, that is, FGPG0 (solid line). FIG. 5C shows the waveform of the feedback correction coefficient FAF.

In the basic updating process, (FAFSM −1) is regarded as being equivalent to the deviation ΔFGPG=FGPG0−FGPG when updating the FGPG (see expression (6)). However, a certain length of time will be taken for the deviation ΔFGPG between the vapor concentration correction coefficient FGPG and the value FGPG0 corresponding to the actual fuel concentration to be reflected on the oscillation center FAFSM of the feedback correction coefficient FAF. Therefore, when the actual fuel concentration of the purge gas sharply changes, (FAFSM −1) fails to follow the resultant change in the deviation ΔFGPG, resulting in a difference therebetween.

FIG. 5B represents a case where the vapor concentration correction coefficient FGPG is sharply updated in the negative direction upon start of purging, and thereafter gradually updated toward the reference value 0. When purging is started, a large amount of vaporized fuel is normally adsorbed in the canister 14. Accordingly, the vapor concentration correction coefficient FGPG is rapidly updated in the negative direction, i.e., the direction indicating that the purge gas is fuel-rich, after start of purging.

The fuel concentration of purge gas sharply decreases for a specific period of time as the amount of vaporized fuel within the canister 14 decreases. The FGPG0 shown in FIG. 5B correctly indicates such a sharp decrease in the actual fuel concentration. Meanwhile, the value of FGPG updated by the above-described basic updating process gradually increases as shown by the broken line in FIG. 5B since (FAFSM −1) cannot follow the change in the deviation ΔFGPG.

While the vapor concentration correction coefficient FGPG is excessively small relative to the FGPG0 corresponding to the actual fuel concentration, correction made with the purge correction coefficient FPG excessively reduces the fuel injection time TAU. As a result, the exhaust air-fuel ratio is biased to lean. The oscillation center FAFSM of the feedback correction coefficient FAF then becomes larger than the reference value 1.0 for compensating the bias. In this case, the exhaust air-fuel ratio is controlled to be near the theoretical air-fuel ratio while being biased to lean.

As described above, the basic updating process tends to cause delays in updating the vapor concentration correction coefficient FGPG when the fuel concentration of purge gas sharply changes. Therefore, updating the FGPG by the basic updating process temporarily deteriorates the accuracy of controlling the air-fuel ratio due to sharp change in the fuel concentration.

Exhaust gas contains unpurified contents such as NOx, HC and CO. Therefore, it is important to maintain the exhaust air-fuel ratio around the theoretical air-fuel ratio to realize a desirable state regarding exhaust emissions. It is known that bias of the exhaust air-fuel ratio to rich is more advantageous than that to lean. In particular, to realize a good drivability with the internal combustion engine 20, the bias of the exhaust air-fuel ratio to rich is preferable.

However, the basic updating process tends to bias the exhaust air-fuel ratio to lean when the fuel concentration of purge gas sharply changes during purging. That is, the basic updating process is not ideal for obtaining a desirable state regarding exhaust emissions and good drivability. Especially, in hybrid vehicles, purging of a large amount of fuel is sometimes required during a specific period for which the fuel concentration of purge gas sharply decreases. In this case, the use of the basic updating process may adversely effect the emissions or the drivability of the hybrid vehicle for the reason described above.

In FIG. 5C, the broken lines indicate the upper threshold value FAFM and the lower threshold value FAFN, respectively, which define a dead band therebetween with respect to the reference value 1.0 of the feedback correction coefficient FAF. This dead band is provided to prevent hunting of the vapor concentration correction coefficient FGPG when it is updated. That is, the vapor concentration correction coefficient FGPG is updated only when the feedback correction coefficient FAF, or its oscillation center FAFSM, goes out of the dead band.

Thus, the wider the dead band becomes, the less chances of updating the FGPG become. In other words, the narrower the dead band becomes, the more chances of updating become. Therefore, when delay is likely to occur in updating the FGPG it is possible to improve the response of the updating and suppress the updating delay by narrowing the dead band.

Meanwhile, the rate of updating the FGPG can be increased by changing it by larger steps (will be referred to as "updating step"). Therefore, if the updating step is made larger than normal when a delay in updating of the vapor concentration correction coefficient FGPG is expected, it is possible to prevent the updating delay. In particular, if the updating steps are made larger, the air-fuel ratio is expected to be biased to lean due to delays in updating of the FGPG, the air-fuel ratio is in turn biased to rich, creating a desirable environment regarding the exhaust emissions and the drivability.

In view of the above, the system according to the embodiment detects the state where the fuel concentration of purge gas changes sharply. Upon detection of such state, the dead band is modified to allow updating of the FGPG easily, and expansion of the updating step of the FGPG, thus maintaining good emission characteristic and drivability irrespective of sharp change in the fuel concentration of purge gas.

Figure 6A:
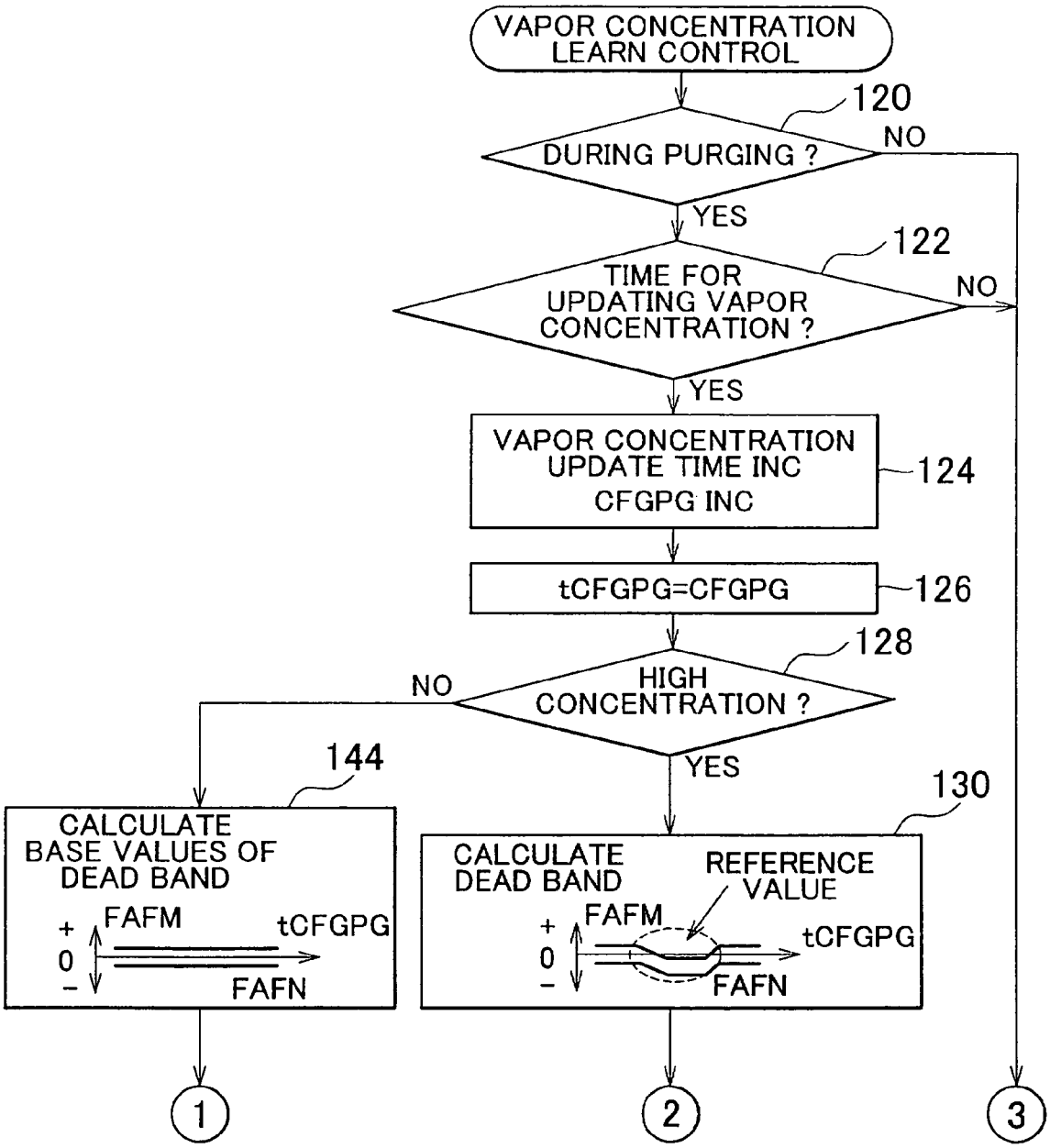
FIGS. 6A and 6B are a flowchart of a routine for updating the vapor concentration correction coefficient FGPG in the system according to the first embodiment.
Figure 6B:
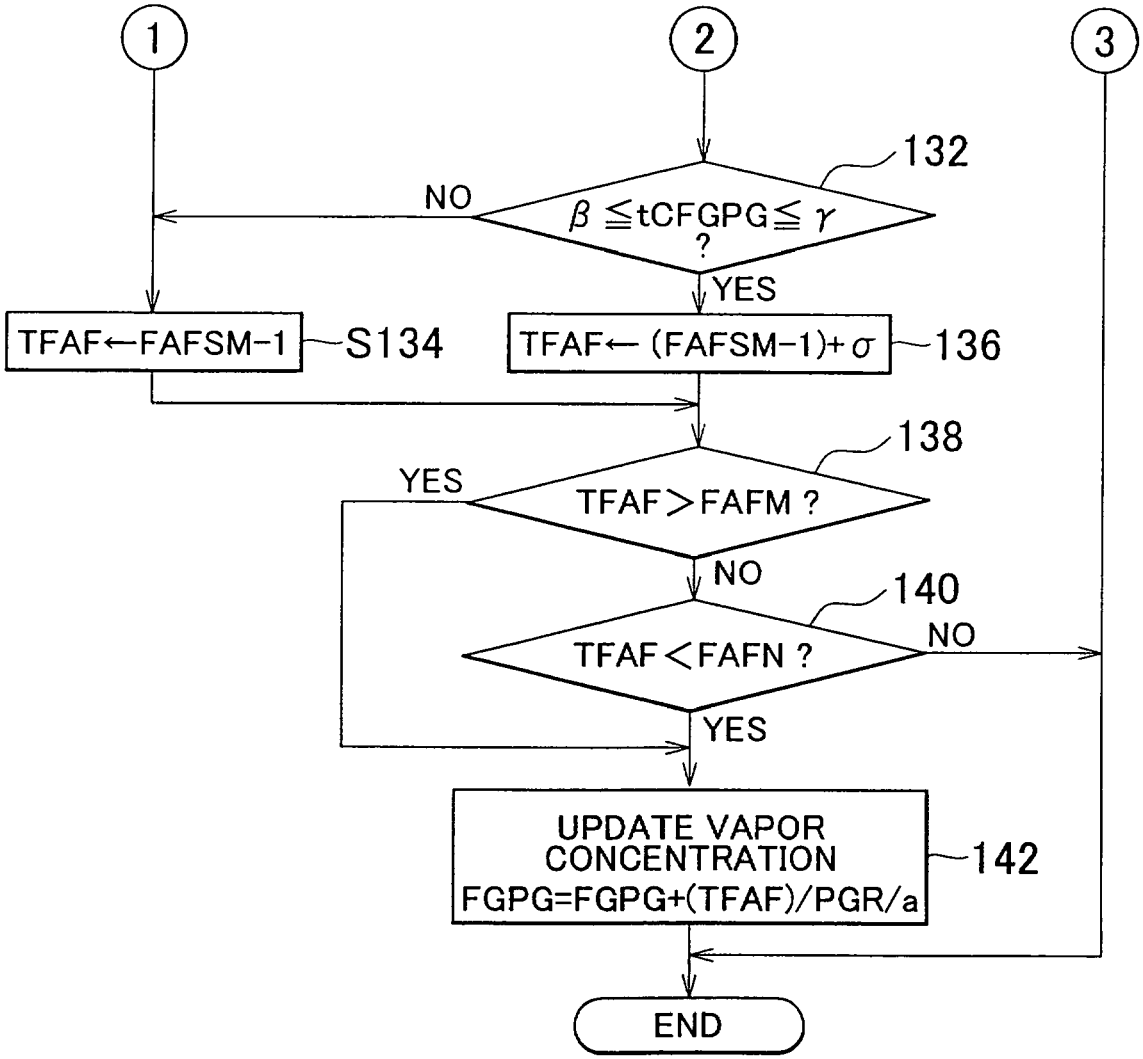

FIG. 6 is a flowchart representing a control routine executed by the ECU 50 to realize the above-described control. The routine is repeated during operation of the internal combustion engine 20. First in step 120, it is determined whether vaporized fuel is currently being purged.

If it is determined that purging is not being performed, the present cycle of the routine ends. Meanwhile, if it is determined that the purge is being performed, the routine proceeds to step 122 where it is determined whether it is the time to update the vapor concentration correction coefficient FGPG In the embodiment, updating of the vapor concentration correction coefficient FGPG is started in response to the feedback correction coefficient FAF switching between rich and lean a certain number of times (e.g., three times), i.e., in response to the output of the oxygen sensor 40 reversing between rich and lean the same number of times.

If it is determined that it is not the time for updating, the present cycle of the routine ends. Conversely, if it is the updating timing, the routine proceeds to step 124 where a vapor concentration updating count CFGPG is incremented. This count is reset to zero by initialization at start-up of the internal combustion engine 20, and therefore, the updating count CFGPG indicates the number of times that the FGPG has been updated from the start-up of the internal combustion engine 20.

After the updating count CFGPG is incremented, the new updating count CFGPG is stored as the current updating count tCFGPG in step 126. Subsequently, it is determined based on the vapor concentration correction coefficient FGPG in step 128 whether the fuel concentration of purge gas is sufficiently high. More specifically, it is determined whether the latest value of the vapor concentration correction coefficient FGPG is a negative value which is larger in an absolute sense (more negative) than a predetermined rich determination value (negative).

If YES in step 128, that is, if it is determined that the fuel concentration of purge gas is sufficiently high, it means that a large amount of vaporized fuel is currently being purged from the canister 14. In this case, it is expected that the amount of the fuel within the canister 14 will decrease to cause a sharp decrease in the fuel concentration of the purge gas.

In this case, therefore, the ECU 50 proceeds to step 130 and sets the dead band appropriately on the assumption that the fuel concentration of purge gas sharply decreases as the purging proceeds. Note that, as mentioned earlier, the dead band is used to determine whether updating of the FGPG is required. The ECU 50 stores the map for setting the upper threshold value FAFM and the lower threshold value FAFN of the dead band relative to the current updating count tCFGPG as shown by step 130 of the flowchart. The dead band (between FAFM and FAFN) is set based on the map in step 130.

The fuel concentration of purge gas sharply decreases in response to the amount of the vaporized fuel within the canister 14 decreasing down to a sufficiently low level after the start of the purging. So, the time point at which the sharp change in the concentration occurs can be identified with a certain degree of accuracy using the updating count tCFGPG. Note that the fuel concentration of purge gas converges to a specific value upon establishment of an equilibrium between the amount of the vaporized fuel generated within the fuel tank 10 and the amount of the vaporized fuel flowing out of the canister 14. The time point at which the amount of the vaporized fuel produced within the fuel tank 10 and the amount of the purged vaporized fuel reach an equilibrium can be identified, with a certain degree of accuracy, by the updating count tCFGPG.

Therefore, the map shown in step 130 of FIG. 6 is set such that the upper threshold value FAFM and the lower threshold value FAFN of the dead bands take standard values ($+\alpha$ and $-\alpha$) immediately after start of purging, and then shift in the negative direction by predetermined amounts, respectively, over the period where a sharp decrease in the fuel concentration of purge gas is expected to occur, and the FAFM and FAFN then return to the standard values when the amount of the vaporized fuel being produced and the amount of the vaporized fuel being purged reaches an equilibrium, i.e., the time when the fuel concentration of the purge gas converges to a specific value. Thus, with this map, the dead band is shifted in the negative direction from its normal position only for the period from when the fuel concentration of purge gas sharply decreases to when the concentration converges to the specific value.

The routine then proceeds from step 130 to step 132 where it is determined whether the current updating count tCFGPG is between $\beta$ and $\gamma$. The relationship of $\beta \leqq tCFGPG \leqq \gamma$ remains true over the period for which the fuel concentration of purge gas is expected to sharply decrease, i.e., the period over which the upper and lower threshold values FAFM and FAFN of the dead band shift in the negative direction in step 130.

Meanwhile, $\beta \leqq tCFGPG \leqq \gamma$ is not true immediately after start of purging or after purging has continues for a certain period of time. In this case, a concentration updating base value TFAF is calculated using the following expression in step 134:

$$TFAF = FAFSM - 1 \quad \ldots (7)$$

In the above expression, FAFSM−1 on the right represents ΔFAFSM, the deviation of the oscillation center of the feedback correction coefficient FAF from the reference value 1.0. Thus, the concentration update base value TFAF is set to the deviation ΔFAFSM in the state where no sharp decrease in the fuel concentration of the purge is expected (non-sharp change state).

If it is determined in step 132 that $\beta \leqq tCFGPG \leqq \gamma$ is true, the routine proceeds. to step 136 where the concentration updating base value TFAF is calculated using the following expression:

$$TFAF=(FAFSM-1)+\delta \quad (8)$$

In the above expression (8), δ is the value used for modifying the concentration updating base value TFAF to be larger than normal. For example, δ may be set to about 0.02 which is 2% of the standard value of the TFAF. By this process, the concentration update base value TFAF is made larger than normal when the fuel concentration of purge gas decreases sharply.

Subsequently in step 138, it is determined whether the concentration updating base value TFAF is larger than the upper threshold value FAFM. If it is determined in this step that TFAF>FAFM is not true, the routine proceeds to step 140 where it is determined whether the concentration update base value TFAF is smaller than the lower threshold value FAFN. Unless these conditions are both satisfied, it is considered that the concentration update base value TFAF is within the dead band. In this case, it is considered that the shift amount ΔFAFSM of the oscillation center FAFSM is sufficiently small. The shift amount ΔFAFSM has a correlation with the magnitude of deviation of the vapor concentration correction coefficient FGPG from the FGPG0 corresponding to the actual fuel concentration of purge gas. So there is no need to update the vapor concentration correction coefficient FGPG when the deviation ΔFAFSM is small. As such, if it is determined that the TFAF is within the dead band, the ECU 50 ends the present cycle of the routine without updating the vapor concentration correction coefficient FGPG.

Meanwhile, if a condition of step either 138 or 140 is satisfied, it means that the concentration update base value TFAF is out of the dead band. In this case, the vapor concentration correction coefficient FGPG is updated using the following expression in step 142:

$$FGPG=FGPG+(TFAF/PGR)/a \quad (9)$$

where "FGPG" on the left is the value after updating, and "FGPG" on the right is the value before updating, and "a" on the right is a moderator coefficient.

The expression (9) is basically the same as the expression (3) used in the basic updating process except that the moderator coefficient a is employed. If it is determined that the fuel concentration of purge gas is high in step 128 of the flowchart shown in FIG. 6, the upper threshold value FAFM is lowered, and the concentration update base value TFAF is set to the value larger than normal by δ for the period where the fuel concentration of the purge gas may sharply changes.

When the actual fuel concentration of purge gas decreases, the oscillation center FAFSM of the FAF raises so that the concentration update base value TFAF changes in the positive direction by the amount corresponding to the delays in updating the vapor concentration correction coefficient FGPG For example, assuming that the upper threshold value FAFM of the dead band is the normal value +α, updating of the FGPG is not allowed until the TFAF exceeds the +α. Therefore, if the TFAF is set lower, updating of the FGPG is started earlier. As such, by the routine of FIG. 6, the FGPG becomes more likely to be updated when the fuel concentration of purge gas is expected to decrease sharply.

As the expression (9) indicates, the magnitude of the updating step of the FGPG is proportional to the TFAF. The larger the absolute value of the TFAF becomes, the higher the rate of change in the FGPG becomes. If the TFAF is set to the value larger than normal by δ when the fuel concentration of purge gas decreases sharply, the updating speed of the FGPG is increased, in step 136, by the rate corresponding to the added δ to cope with the sharp change in the fuel concentration.

As described above, the control routine shown in FIG. 6 allows the vapor concentration correction coefficient FGPG to be rapidly increased when the fuel concentration of purge gas sharply decreases. That is, this routine updates the vapor concentration correction coefficient FGPG such that it follows sharp changes in the fuel concentration of purge gas. Thus, the system according to the embodiment achieves the desired characteristics regarding exhaust emissions and drivability, without being influenced by sharp changes in the fuel concentration of purge gas during purging.

In the case where the amount of the vaporized fuel adsorbed in the canister 14 is considerably small, it is determined that the fuel concentration of purge gas is not high in step 128. In this case, the ECU 50 proceeds to step 144 and sets the dead band on the assumption that the fuel concentration of purge gas will not sharply change.

More specifically in step 144, the upper and lower threshold values FAFM and FAFN of the dead band are set in accordance with a map stored in the ECU 50. As step 144 of the flowchart shown in FIG. 6 indicates, the upper and the lower threshold values FAFM and FAFN are always set to their normal values (+α and −α) irrespective of the time elapsing from the start of purging (current value of updating count tCFGPG).

That is, if it is determined in step 128 that the fuel concentration of purge gas is not high, the concentration updating base value TFAF is set in step 134 subsequent to step 144 described above. In step 134, the concentration update base value FAFSM is set to ΔFAFSM=FAFSM−1, as deviation of the oscillation center FAFSM from its reference value.

In the case where the fuel concentration is already low immediately after the start of purging, no sharp change in the fuel concentration of the purge gas occurs during purging. If the dead band is modified to increase the TFAF despite that there will be no sharp change in the fuel concentration of purge gas, the updating speed of the vapor concentration correction coefficient FGPG becomes excessively high, thus failing to obtain the desired characteristic regarding exhaust emissions and drivability. Thus, the aforementioned control surely prevents the high-speed updating when the fuel concentration does not sharply change. The system according to the embodiment is capable of always providing desired characteristic regarding exhaust emissions and good drivability without being influenced by the adsorption state of the vaporized fuel at start of purging.

In the first embodiment, a map that specifies the dead band (between FAFM and FAFN) relative to the purge period is employed in step 10. However, the map is not limited to the one as described above so long as the dead band is changeable while the fuel concentration of purge gas decreases sharply. For example, the map that specifies the dead band relative to the total purge amount or to the purge period (total purge period) may be employed.

In the first embodiment, the upper threshold value FAFM of the dead band is reduced, and the concentration updating base value TFAF is increased in the positive direction during the sharp decrease in the fuel concentration of purge gas. However, the process is not limited to it. For example, it is possible to increase the lower threshold value FAFN of the dead band and makes the TFAF larger in the negative direction in response to detection of a sharp increase in the fuel concentration of purge gas.

In the first embodiment, the sharp change in the fuel concentration of purge gas is estimated based on the current updating count tCFGPG However, the estimation is not limited to it. For example, the sharp change in the fuel concentration may be estimated based on the rate of change in the FGPG.

In the first embodiment, the feedback correction coefficient FAF is updated based on an output of the oxygen sensor 40 disposed upstream of the catalyst 38. However, the updating process is not limited to it. For example, an air-fuel ratio sensor for outputting the signal that indicates the exhaust air-fuel ratio may be disposed upstream of the catalyst 38. In this case, the feedback correction coefficient FAF is calculated based on the difference between the exhaust air-fuel ratio and the target air-fuel ratio. The thus calculated value is further smoothed so as to be set to the oscillation center FAFSM. Then the timing for updating the FGPG is determined based on the number of times fuel has been injected, instead of the number of times the value of FAF has switched between rich and lean (see step 122 in FIG. 6), so as to realize the same operation as the one obtained in the first embodiment.

Second Embodiment

The second embodiment of the invention will be described referring to FIG. 7. In the second embodiment, the system according to the first embodiment is employed such that the ECU 50 executes the routine shown in FIG. 7 instead of the one shown in FIG. 6.

In the first embodiment, the possibility of sharp changes in the fuel concentration is determined based on the fuel concentration of purge gas. However, in the case where the internal combustion engine 20 is started in a sufficiently warm state, a large amount of vaporized fuel has been already generated within the fuel tank 10 so as to be supplied to the canister 14. Accordingly, the fuel concentration of purge gas hardly decreases during purging.

In the system according to the second embodiment, a determination is made whether the internal combustion engine 20 has been warm-started or cold-started. If it is determined that the engine 20 has been cold-started, the vapor concentration correction coefficient FGPG is updated by the same process as the first embodiment, which assumes a sharp decrease in the fuel concentration of purge gas. Meanwhile, if it is determined that the engine 20 has been warm-started, the FGPG is updated by a process that assumes no sharp decreases in the fuel concentration of purge gas.

Figure 7A:
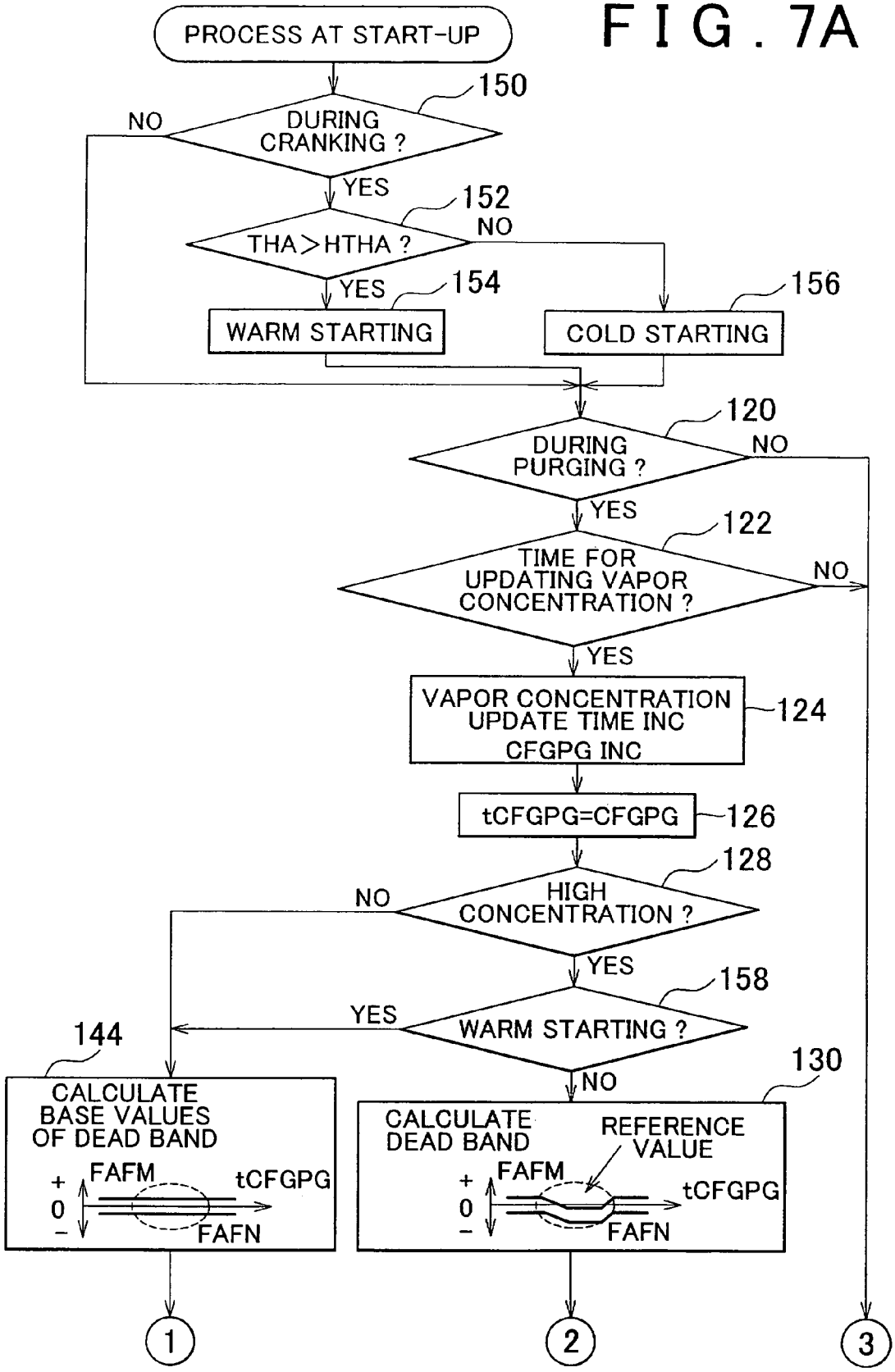
FIGS. 7A and 7B are a flowchart of a routine to be executed by the system according to a second embodiment.
Figure 7B:
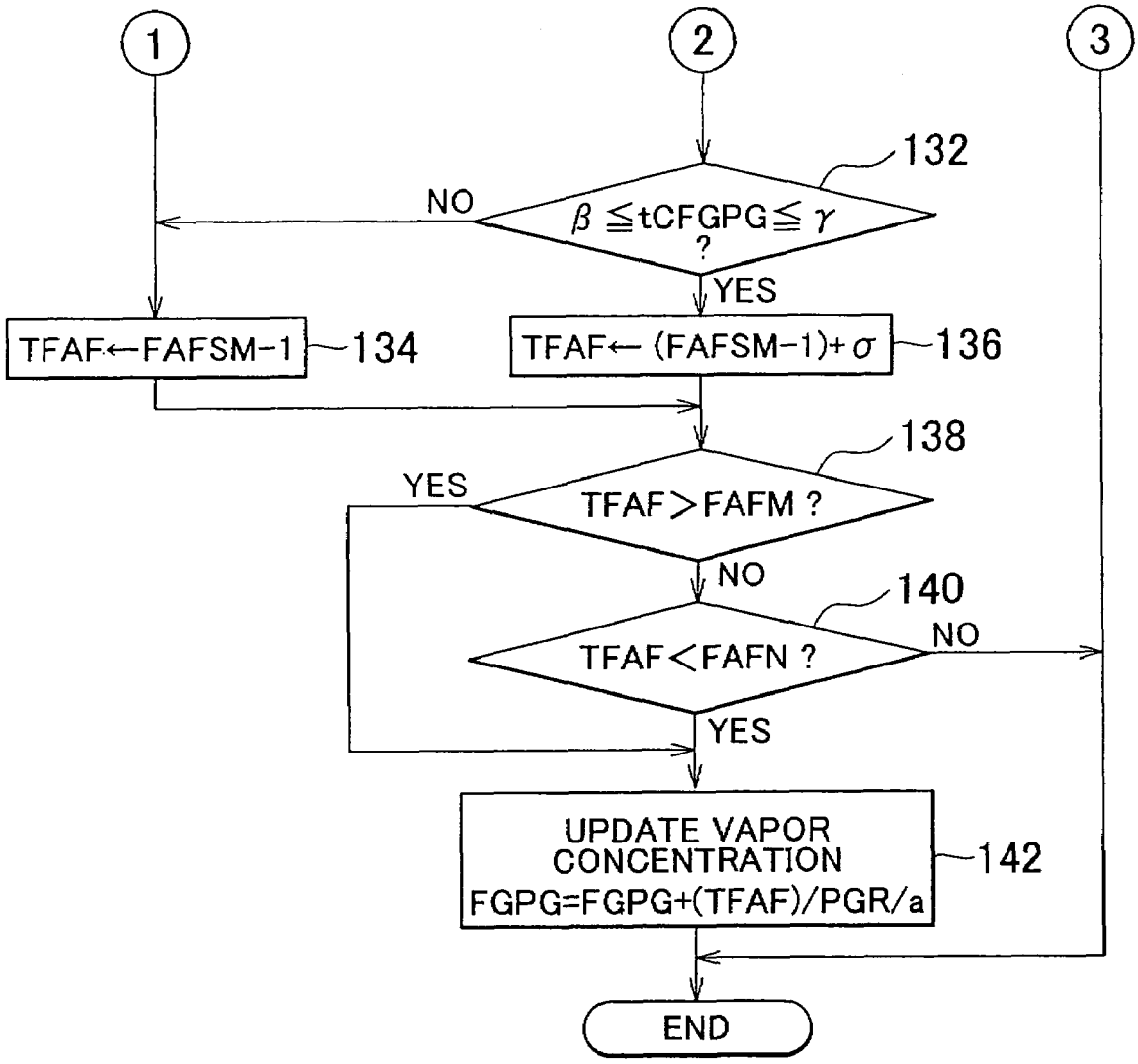

FIG. 7 shows a flowchart of the routine executed by the ECU 50 that performs the aforementioned function. The routine of FIG. 7 is the same as that of the flowchart shown in FIG. 6 except that steps 150 to 156 are inserted before step 120, and step 158 is inserted before step 130. Steps in FIG. 7 which are the same as those shown in FIG. 6 will be designated with the same reference numerals, and the explanation thereof, thus, will be briefly made or omitted.

The routine shown in FIG. 7 is activated at predetermined cycles repeatedly while the ignition switch of the vehicle is kept ON. In step 150, it is determined whether cranking is currently performed in the internal combustion engine 20. If the cranking is not currently performed, the routine proceeds to step 120 and subsequent steps.

If it is determined that the cranking is currently performed, the routine proceeds to step 152 where it is determined whether an intake air temperature THA is higher than a warm-start reference value HTHA (40° C., for example). If THA is higher than HTHA, i.e., THA>HTHA, it is determined that the engine has been warm-started in step 154. Meanwhile, if it is determined that THA is not higher than HTHA, it is determined that the engine has been cold-started in step 156.

In the routine shown in FIG. 7, if it is determined that the fuel concentration of purge gas is high in step 128, the routine proceeds to step 158 where it is determined whether the engine has been warm-started. If warm starting is determined, it is considered that a large amount of vaporized fuel has been generated within the fuel tank 10 and is available from immediately after start of purging, and therefore, the fuel concentration does not decrease sharply as the purging proceeds. In this case, the normal dead band is set in step 144 and subsequent steps in each cycle, and the normal concentration updating base value TFAF is set in step 134.

If warm starting is not determined in step 158, in other words, if the engine has been cold-started, it is considered that the fuel concentration of purge gas sharply decreases as the purging proceeds. In this case, the dead band and the concentration update base value TFAF are set in steps 130 and 136, respectively, so as to increase the speed of updating the FGPG and thereby cope with sharp decreases in the fuel concentration.

In the routine shown in FIG. 7, by determining whether the internal combustion engine 20 has been warm-started or cold-started, the process for increasing the speed of updating the FGPG is executed only when a sharp decrease in the fuel concentration of purge gas is expected. Thus, as compared to the first embodiment, the system of the second embodiment further improves the characteristics of the internal combustion engine 20 regarding its exhaust emissions and drivability.

In the second embodiment, the intake air temperature THA at start-up of the engine is used for distinguishing between the cold starting and warm starting. However, the aforementioned determination may be made based on, instead of the intake air temperature THA, other parameter correlated with the temperature of the internal combustion engine 20, such as a cooling water temperature THW and the temperature of fuel.

Third Embodiment

The third embodiment of the invention will be described referring to FIG. 8. In the third embodiment, the system according to the first or the second embodiment is employed such that the ECU 50 executes the routine shown in FIG. 8 instead of steps 130, 132 and 136 of FIGS. 6 and 7.

In the first or the second embodiment, the time the fuel cell concentration of purge gas converges to a specific level, i.e., the time a sharp decrease in the fuel concentration of purge gas ends, is estimated based on the total purge time (updating count tCFGPG). Meanwhile in the third embodiment, the convergence timing can be estimated further accurately based on the temperature of the internal combustion engine 20 or the total purge amount, as will be described below.

As aforementioned, the fuel concentration of purge gas sharply decreases temporarily as purging proceeds, and thereafter converges to a specific level. This convergence timing is correlated with the total amount of vaporized fuel that has been purged. Also, the convergence timing varies with the amount of vaporized fuel that has flown from the fuel tank 10 to the canister 14. The amount of the vaporized fuel that has flown into the canister 14 from the fuel tank 10 is correlated with the temperature of the fuel tank 10, that is, the temperature of the internal combustion engine 20. It is, thus, possible to estimate the convergence timing of the fuel concentration of purge gas accurately based on the total purge amount and the temperature of the internal combustion engine 20.

Figure 8:
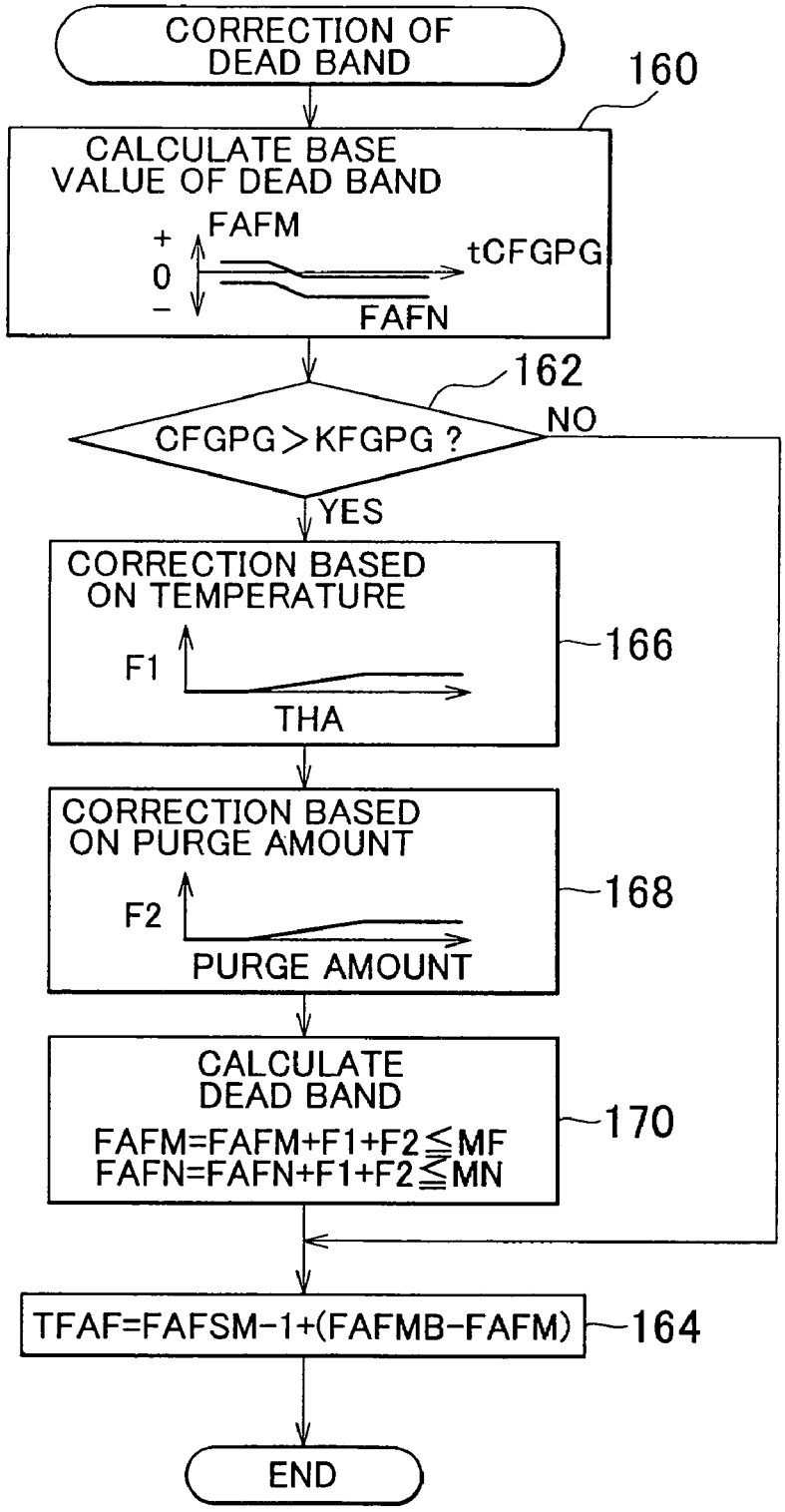
FIG. 8 is a flowchart of a routine to be executed by the system according to a third embodiment.

FIG. 8 is a flowchart of the routine executed by the ECU 50 for setting the concentration updating base value TFAF based on the convergence timing of the fuel concentration of purge gas which has been estimated by the aforementioned process. The routine shown in FIG. 8 is executed instead of steps 130, 132 and 136 shown in FIGS. 6 and 7.

In the system according to the embodiment, the routine shown in FIG. 8 will be executed after the condition in step 128 of FIG. 6 or in step 158 of FIG. 7 has been established. First in step 160, the upper and the lower threshold values FAFM and FAFN of the dead band are set based on the current updating count tCFGPG.

In step 160, the upper and the lower threshold values FAFM and FAFN of the dead band are set in accordance with the map stored in the ECU 50. The map used herein is set to maintain the upper and the lower threshold values FAFM and FAFN at normal values ($+\alpha$ and $-\alpha$) until the time at which the fuel concentration of purge gas is estimated to sharply decrease, and thereafter, to shift each of those values in the negative direction by a predetermined value $\eta$.

Then in step 162, it is determined whether the updating count CFGPG has exceeded a convergence reference value KFGPG The convergence reference value KFGPG is the value based on which it is determined whether the fuel concentration is about to converge to the specific level. If CFGPG>KFGPG is not true, it is determined that the fuel concentration is not about to converge to the specific level. In this case, the concentration updating base value TFAF is calculated using the following expression in step 164:

$$TFAF=(FAFSM-1)+(FAFMB-FAFM) \quad \ldots (10)$$

In the expression (10), FAFMB on the right represents the normal value of the upper threshold value FAFM of the dead band, that is, $+\alpha$ in the embodiment. Accordingly, (FAFMB−FAFM) is kept zero while the upper threshold value FAFM is equal to the normal value FAFMB ($\alpha$). In this case, the concentration updating base value TFAF is set directly to (FAFSM−1), that is, the deviation $\Delta$FAFSM of the oscillation center FAFSM. Meanwhile, in the case where the upper threshold value FAFM has been shifted from the normal value FAFMB in the negative direction, the concentration updating base value TFAF is made larger than the deviation $\Delta$FAFSM of the oscillation center FAFS by the amount by which the FAFM has been shifted from the FAFMB, that is, (FAFMB−FAFM).

Accordingly, by the above processes of the routine shown in FIG. 8, the upper and the lower threshold values FAFM and FAFN of the dead band are shifted in the negative direction, and the concentration updating base value TFAF is made larger than a normal value by the shift amount for the period where a sharp decrease in the fuel concentration of purge gas occurs. That is, the dead band and the concentration updating base value TFAF used for the period where a sharp change in the fuel concentration of purge gas occurs can be set in substantially the same manner as those of the first and second embodiments. In the system according to the third embodiment, therefore, the vapor concentration correction coefficient FGPG can be updated without delays while in the fuel concentration of purge gas is changing shapely, just as in the first and the second embodiments.

Back to step 162 of FIG. 8, if it is determined in this step, conversely, that CFGPG>KFGPG is true, it is considered that the fuel concentration is about to converge to the specific level. The routine then proceeds to step 166 where a temperature correction value F1 is calculated. The temperature correction value F1 is used for correcting the upper and the lower threshold values FAFM and FAFN of the dead band.

As step 166 shows, the ECU 50 stores a map that specifies the temperature correction value F1 relative to the intake air temperature THA. In step 166, the temperature correction value F1 is set in accordance with the map. The map changes the temperature correction value F1 towards the upper limit value ($\eta/2$) as the intake air temperature THA increases. The map specifies to make the temperature correction value F1 larger as the amount of the vaporized fuel generated in the fuel tank 10 becomes larger.

Then in step 168, a purge amount correction value F2 is set. Like the temperature correction value F1 , the purge amount correction value F2 is used for correcting the upper and the lower threshold values FAFM and FAFN of the dead band. The purge amount correction value F2 is set in accordance with the map shown in step 168. According to the map, the purge amount correction value F2 is increased toward the upper limit value ($\eta/2$) as the total purge amount increases, thus in synchronization with the fuel concentration of purge converging to the specific level.

After setting the purge amount correction value F2, the upper and the lower threshold values FAFM and FAFN of the dead band are calculated using the following expression in step 170:

$$FAFM=FAFM+F1+F2$$

$$FAFN=FAFN+F1+F2 \quad \ldots (11)$$

where FAFM and FAFN on the right are those set in step 160.

Thus, by the above processes, the upper and the lower threshold values FAFM and FAFN that have been lowered in the negative direction each by $\eta$ to cope with sharp decreases in the fuel concentration are brought back to the normal values ($+\alpha$ and $-\alpha$) as the warming-up of the internal combustion engine 20 proceeds and the total purging amount increases, more specifically, as the fuel concentration of purge gas converges to the specific level. Thereafter, when the upper threshold value FAFM has thus returned to the normal value $+\alpha$, the concentration updating base value TFAF calculated in step 164 is then started to be set directly to the deviation $\Delta$FAFSM of the oscillation center FAFSM.

Like the first or the second embodiment, the routine shown in FIG. 8 enables the FGPG to be quickly updated during the period where the fuel concentration of purge gas sharply changes. Then, when the fuel concentration stops changing sharply, the updating process that updates the FGPG at a normal speed resumes. In particular, since the processes of FIG. 8 determine the time at which the sharp change in the fuel concentration of purge gas stops based on the total purge amount and the intake air temperature THA, the accuracy of the determination can be further enhanced. Accordingly, the system of the present embodiment further improves the characteristics of the internal combustion engine 20 regarding its emissions and drivability.

In the third embodiment, the temperature correction value F1 is set based on the intake air temperature THA. The aforementioned process for setting the temperature correction value F1 may be executed based on the parameter other than the intake air temperature THA, for example, a cooling water temperature, a fuel temperature and the like so long as it is correlated with the temperature of the internal combustion engine 20.

Fourth Embodiment

The fourth embodiment of the invention will be described referring to FIG. 9. In the fourth embodiment, the system shown in FIG. 1 is employed such that the ECU 50 executes the routine shown in FIG. 9 to be described later.

In the foregoing first to the third embodiments, the dead band of the concentration updating base value TFAF based on which the need of updating the vapor concentration correction coefficient FGPG is determined, and the value of TFAF used for the period where the fuel concentration of purge gas sharply changes are changed so as to increase the updating speed of the FGPG. This feature is, however, realized by different processes in the fourth embodiment, as will be described below.

Figure 9A:
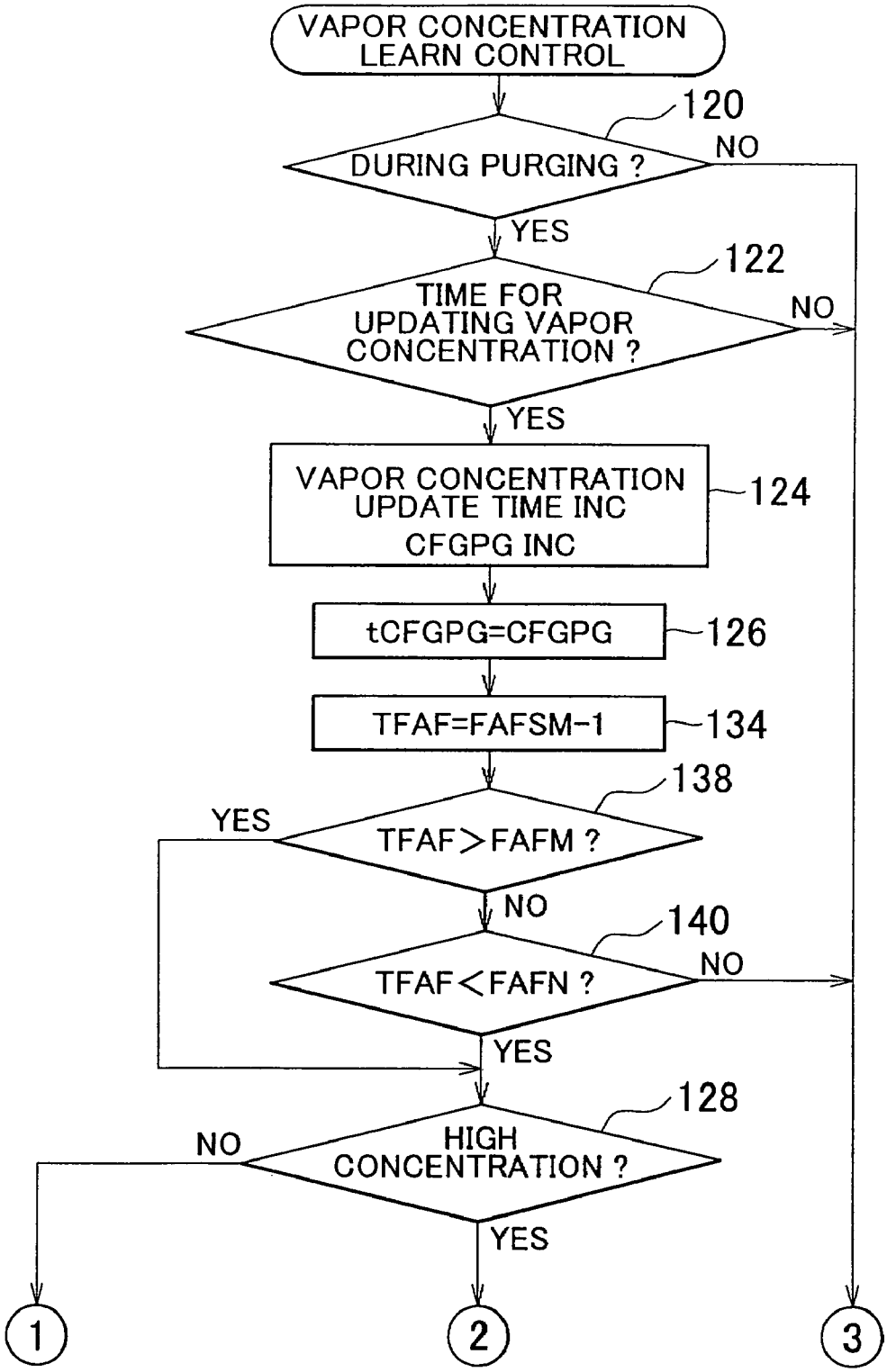
FIGS. 9A and 9B are a flowchart of a routine to be executed by the system according to a fourth embodiment.
Figure 9B:
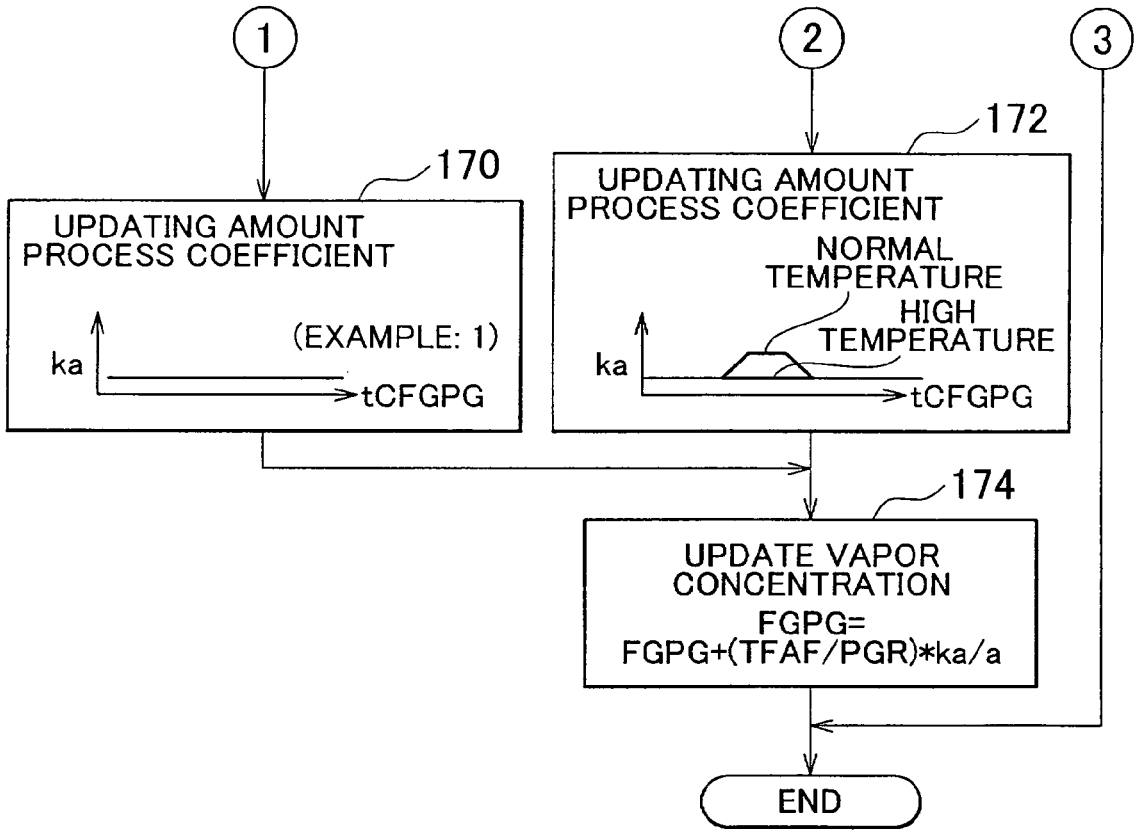

FIG. 9 is a flowchart of the routine executed by the ECU 50 for updating the vapor concentration correction coefficient FGPG This routine, like those of FIG. 6 or 7, is repeatedly executed at predetermined cycles during the operation of the internal combustion engine 20. The steps shown in the flowchart of FIG. 9 which are the same as those shown in FIG. 6 or 7 will be designated with the same reference numerals, and explanations thereof will be briefly made or omitted.

According to the routine shown in FIG. 9, in steps 120 to 126, the current updating count tCFGPG is incremented and verified, as it is in the routines shown in FIG. 6 or 7. Then in step 134, the deviation of the oscillation center FAFSM, that is, ΔFAFSM=FAFSM−1, is set to the concentration updating base value TFAF.

In steps 138 and 140, it is determined whether the thus set concentration updating base value TFAF is out of the dead band. The dead band herein is the regular dead band that ranges between the normal upper and lower threshold values FAFM and FAFN., i.e., between $+\alpha$ and $-\alpha$.

If it is determined that the TFAF is within the dead band, it is determined that updating of the vapor concentration correction coefficient FGPG is not required, and the cycle ends immediately. Meanwhile if it is determined that the TFAF is out of the dead band, it is determined in step 128 whether the fuel concentration of purge gas is sufficiently high.

If the fuel concentration of purge gas is not sufficiently high, it is considered that there will be no sharp decrease in the fuel concentration during the purging. In this case in the routine shown in FIG. 9, an updating amount process coefficient ka is set by a first process illustrated in the map of step 170. In this map, the updating amount process coefficient ka is always set to a standard value (1.0) irrespective of the current updating count tCFGPG On the other hand, if it is determined in step 128 that the fuel concentration of purge gas is sufficiently high, the updating amount process coefficient ka is set in accordance with a second process illustrated in the map of step 172, on the assumption that there will be a sharp decrease in the fuel concentration during the purging. In this map, if the temperature of the internal combustion engine 20 is higher than a reference level, the updating amount process coefficient ka is set to the standard value (1.0). Meanwhile, if the temperature of the internal combustion engine 20 is equal to or lower than the reference level, the updating amount process coefficient ka is set larger than the standard value while the current updating count tCFGPG is within a predetermined range.

The above predetermined range corresponds to the period during which the fuel concentration of purge gas sharply decreases. Accordingly, by the aforementioned processes, the updating amount process coefficient ka is made larger than the standard value only for the period in which the fuel concentration of purge gas is expected to decrease sharply, when the conditions for such sharp changes in the purge gas fuel concentration, such as the temperature of the internal combustion engine 20 being low, are actually in effect.

Then in step 174, the updated value of the vapor concentration correction coefficient FGPG is calculated using the following expression:

$$FGPG=FGPG+(TFAF/PGR)\times ka/a \quad \ldots (12)$$

where "a" on the right represents a moderator coefficient (for example, 2) like the "a" in the expression (9).

In the embodiment, the TFAF corresponds to the deviation of the oscillation center FAFSM (ΔFAFSM=FAFSM−1), and the value of (TFAF/PGR) therefore represents the amount of the same deviation per 1% of the purge rate. So, the expression (12) determines the magnitude of the updating step of the FGPG by multiplying the FAFSM deviation amount per 1% of the purge rate with ka/a.

As such, according to the aforementioned processes, if the updating amount process coefficient ka is equal to the standard value 1.0, the magnitude of the updating step is set to the value obtained by dividing the (TFAF/PGR) by the moderator coefficient "a". If the ka is larger than the standard value 1.0, on the other hand, the FGPG is updated with a larger updating step.

Accordingly, in the routine shown in FIG. 9, the updating amount process coefficient ka is set larger than the reference value 1.0 only for the period where a sharp decrease in the fuel concentration of purge gas actually occurs. That is, the FGPG is updated with the normal updating step over the period where the fuel concentration of purge gas does not sharply change, and with a larger updating step over the period where the fuel concentration of purge gas sharply changes.

As described above, the routine shown in FIG. 9 makes it possible to realize the same effects as those obtained in the routines shown in FIGS. 6 and 7 without changing the dead band based on which the need for updating of the FGPG is determined and/or the concentration updating base value TFAF. The system according to the fourth embodiment is capable of realizing the same effects and advantages as those obtained with the systems of the first to the third embodiments.

Fifth Embodiment

The fifth embodiment of the invention will be described referring to FIG. 10. In the embodiment, the system according to the fourth embodiment is employed such that the ECU 50 executes the routine shown in FIG. 10 instead of steps 128, and 170 to 174.

In step 172 of the routine according to the fourth embodiment, the determination is made whether the temperature of the internal combustion engine is normal or high, and the updating amount process coefficient ka is set accordingly, based on the current updating count tCFGPG Meanwhile, the system according to the fifth embodiment is capable of obtaining the temperature of the internal combustion engine 20 (intake air temperature THA) and the total purge amount more accurately, and thus determining the updating amount process coefficient ka more accurately.

Figure 10:
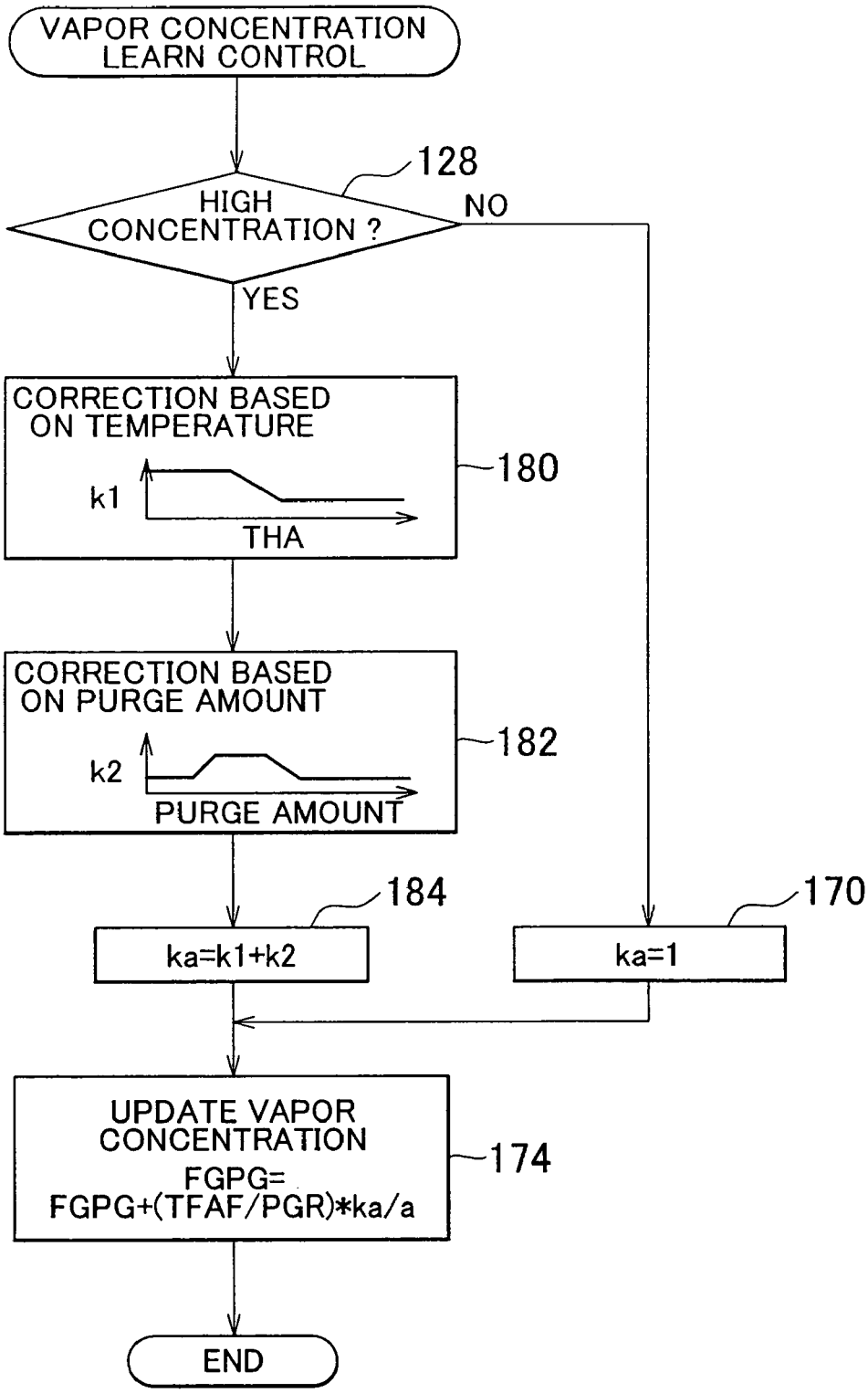
FIG. 10 is a flowchart of a routine to be executed by the system according to a fifth embodiment.

FIG. 10 is a flowchart of the routine executed by the ECU 50 for setting the updating amount process coefficient ka, and updating the vapor concentration correction coefficient FGPG using the ka. The routine shown in FIG. 10 is executed instead of steps 128, and 170 to 174 shown in FIG. 9. In the system according to the embodiment, if it is determined that the concentration updating base value TFAF is out of dead band in the routine shown in FIG. 9 (see steps 138 and 140), the routine shown in FIG. 10 will be executed.

In step 128, it is determined whether the fuel concentration of purge gas is sufficiently high. If the fuel concentration is not sufficiently high, it is considered that the fuel concentration is not expected to sharply decrease. Then the routine proceeds to step 170 where the updating amount process coefficient ka is set to the reference value 1. Then in step 174, the FGPG is updated in accordance with the expression (12). These processes are substantially the same as those executed in the steps designated with the same reference numerals shown in FIG. 9.

Referring to the flowchart shown in FIG. 10, if it is determined in step 128 that the fuel concentration of purge gas is sufficiently high, a temperature correction coefficient k1 is set according to the map in step 180. The map is set relative to the intake air temperature THA. More specifically, if the THA is in a high range, the k1 is set equal to a standard value, that is, ½. Meanwhile, if the THA is in a low range, the k1 is set larger than the standard value. Referring to the map, in a high temperature environment that is likely to generate a large amount of vaporized fuel within the fuel tank 10, the temperature correction coefficient k1 is set to the standard value, i.e., ½. Meanwhile, in a low temperature environment that is unlikely to generate a large amount of vaporized fuel, the k1 is set to be larger the standard value.

Then the routine proceeds to step 182 where a purge amount correction coefficient k2 is set. The purge amount correction coefficient k2 is set based on the total purge amount in accordance with the map shown in step 182 of the flowchart. With the map, the purge amount correction coefficient k2 is set to its standard value, which is ½, immediately after the start of purging. It is then made larger than the standard value at the time the amount of vaporized fuel desorbed from the canister 14 is expected to start decreasing sharply. Thereafter, the purge amount correction coefficient k2 is returned to the standard value 1/2 after the fuel concentration of purge gas converges to a stable value as the purging further proceeds.

After setting the purge amount correction coefficient k2, the routine proceeds to step 184 where the updating amount process coefficient ka is calculated with the following expression:

$$ka=k1+k2 \quad \ldots (13).$$

The temperature correction coefficient k1 and the purge amount correction coefficient k2 are set larger than ½, i.e., the standard value, under the condition where a sharp decrease in the fuel concentration of purge gas is expected to occur, while they are set to ½ under the condition where no sharp decrease in the fuel concentration of purge gas is expected. More specifically, in the above routine, the updating amount process coefficient ka is set to be larger than 1.0 as its standard value when both of the intake air temperature THA and the total purge amount show the possibility of a sharp decrease in the fuel concentration, while it is set to 1.0 when neither of the intake air temperature THA nor the total purge amount shows the possibility.

That is, since, in step 174, the updating speed of the vapor concentration correction coefficient FGPG is made higher as the updating amount process coefficient ka becomes larger, it is possible to increase the updating speed of the FGPG when the intake air temperature THA and the total purge amount indicate the possibility of a sharp decrease in the fuel concentration of purge gas.

As described above, the system according to the fifth embodiment enables the intake air temperature THA and the total purge amount to be reflected on the updating amount process coefficient ka more precisely, as compared with the system according to the fourth embodiment. Thus, in the fifth embodiment, it is possible to more precisely reflect the actual rate of change in the fuel concentration of purge gas on the updated speed of the vapor concentration correction coefficient FGPC which makes the value of the FGPG more accurate. Accordingly, the system according to the fifth embodiment further improves the characteristics of the internal combustion engine 20 regarding its emissions and drivability as compared with the fourth embodiment.

In the fifth embodiment, the temperature correction coefficient k1 is set based on the intake air temperature THA. However, the process for such setting is not limited to the one as described above. The temperature correction coefficient k1 may be set based on other parameter correlated with the temperature of the internal combustion engine 20, such as the cooling water temperature THW, and the fuel temperature.

Sixth Embodiment

The sixth embodiment of the invention will be described referring to FIG. 11. In the sixth embodiment, the system according to any one of the first to fifth embodiment is employed such that the ECU 50 executes the routine shown in FIG. 11 to be described later.

In the system according to any one of the first to the fifth embodiments, the vapor concentration correction coefficient FGPG is initialized to 0 upon start of purging, and thereafter, the FGPG is updated to the value corresponding to the actual fuel concentration of purge gas. Note that the difference between the initial value and the value corresponding to the actual fuel concentration should preferably be as small as possible in order for the FGPG to converge to the specific level promptly. Also, it is to be understood that the initial value of 0, which is employed in the first to the fifth embodiments, as a matter of fact, should be used provided that the air-fuel ratio of purge gas is equal to the target air-fuel ratio of the air-fuel mixture, for the reason described below.

Upon start of purging, a large amount of vaporized fuel is adsorbed within the canister 14. Accordingly, the air-fuel ratio of purge gas normally becomes richer than the target air-fuel ratio. If the vapor concentration correction coefficient FGPG is initially set to 0, it is likely to deviate from the value corresponding to the actual fuel concentration upon start of purging. To counter this, in the sixth embodiment, when it is found immediately after the start of purging that the exhaust air-fuel ratio largely deviates to rich, the vapor concentration correction coefficient FGPG is replaced with an initial vapor concentration correction coefficient FGPGS that is determined so as to correspond to the actual air-fuel ratio of purge gas.

FIG. 1 is a flowchart of the routine executed by the ECU 50 for realizing the aforementioned control. The routine is executed at predetermined cycles repeatedly during the operation of the internal combustion engine 20. When the routine starts, it is determined in step 190 whether the concentration updating base value TFAF, which is herein assumed to have been set directly to the deviation of the oscillation center FAFSM, i.e., ΔFAFSM (=(FAFMSM−1)), is smaller than the lower threshold value FAFN of the dead band.

If TFAF<FAFN is not true, it indicates that the oscillation center FAFSM has not largely shifted in the decreasing direction, that is, the oscillation center FAFSM has not largely deviated to rich. In this case, the control routine ends immediately since it is not necessary to replace the vapor concentration correction coefficient FGPG with the initial vapor concentration correction coefficient FGPGS.

Figure 11:
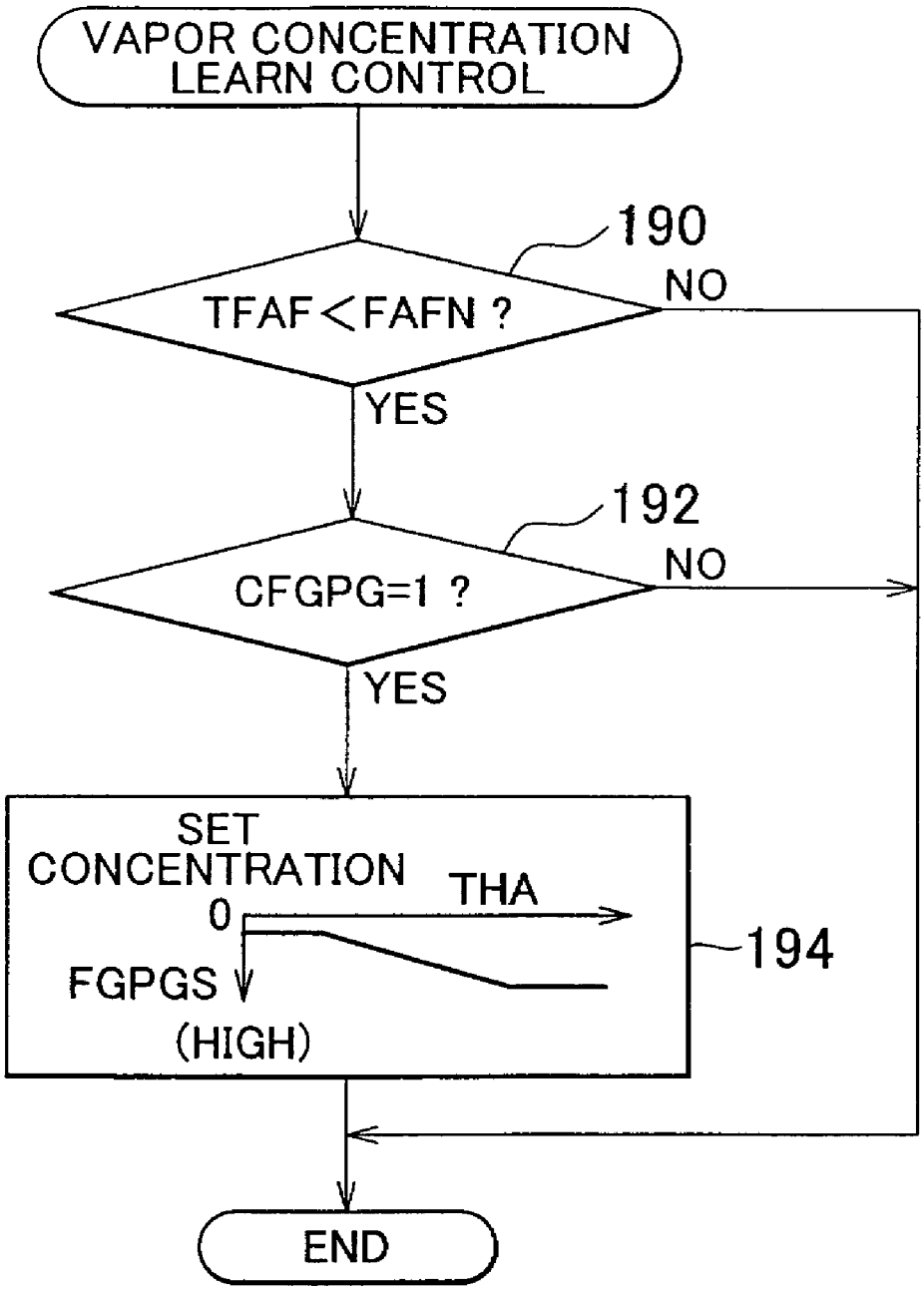
FIG. 11 is a flowchart of a routine to be executed by the system according to a sixth embodiment for setting an initial vapor concentration correction coefficient FGPGS.

In the routine shown in FIG. 11, if it is determined based on the concentration updating base value TFAF that the replacement of the vapor concentration correction coefficient FGPG is not required, such replacement is not performed, so as to prevent making excessive corrections to the FGPG upon start of purging.

If it is determined that TFAF<FAFN is true in step 190, conversely, it is then determined in step 192 whether the vapor concentration updating count CFGPG is 1. In the embodiment, the process for replacing the FGPG by the FGPGS is executed at the timing of CFGPG=1. If the aforementioned condition is not true, the present routine ends immediately.

If CFGPG=1 is true, the routine proceeds to step 194 where the initial vapor concentration correction coefficient FGPGS is set based on the intake air temperature THA in accordance with the map shown in step 194. The map sets the FGPGS to a larger negative value as the intake air temperature THA becomes higher.

As mentioned earlier, the vapor concentration correction coefficient FGPG should be set to a larger negative value as the fuel concentration of purge gas is higher, in order to eliminate the influence of purge gas. Therefore, the process in step 194 sets the FGPGS based on the intake air temperature THA so as to conform to this requirement.

Then, the FGPGS is substituted to the vapor concentration correction coefficient FGPG As such, according to the system of the sixth embodiment, it is possible to set, immediately after the start of purging, the vapor concentration correction coefficient FGPG to a value that accurately corresponds to the actual fuel concentration of purge gas. As a result, the accuracy of the air-fuel ratio control after the start of purging can be significantly improved.

In the sixth embodiment, the initial vapor concentration correction coefficient FGPGS is set based on the intake air temperature THA. However, the process for such setting is not limited to the one as described above. The initial vapor concentration correction coefficient FGPGS may be set based on other parameter correlated with the temperature of the internal combustion engine 20, such as, the cooling water temperature THW and the fuel temperature.

While the invention has been described with reference to exemplary embodiments thereof, it is to be understood that the invention is not limited to the exemplary embodiments or constructions. To the contrary, the invention is intended to cover various modifications and equivalent arrangements other than described above. In addition, while the various elements of the exemplary embodiments are shown in various combinations and configurations, which are exemplary, other combinations and configurations, including more, less or only a single element, are also within the spirit and scope of the invention.

What is claimed is:

1. A vaporized fuel purge system comprising:

a fuel injection valve that injects a fuel in an internal combustion engine;

an exhaust gas sensor that generates an output indicative of an exhaust air-fuel ratio in the internal combustion engine;

an FAF calculation device that calculates, based on the output of the exhaust gas sensor, a feedback correction coefficient applied to a fuel injection amount so that the exhaust air-fuel ratio matches a target air-fuel ratio;

a canister that adsorbs a vaporized fuel produced in a fuel tank;

a purge mechanism that allows a purge gas that contains the vaporized fuel to flow from the canister into the internal combustion engine;

a sharp-change-condition detecting device that detects a sharp-change condition in which a fuel concentration of the purge gas changes at a rate higher than a reference rate;

a concentration updating base value setting device that sets a concentration updating base value based on the feedback correction coefficient by a predetermined process;

a process changing device that changes the predetermined process such that the concentration updating base value is made larger in the sharp-change condition than in a non-sharp-change condition;

a fuel concentration updating device that updates a fuel concentration of the purge gas using the concentration updating base value;

a purge correction coefficient calculation device that calculates a purge correction coefficient that is used to eliminate an influence of the vaporized fuel based on the fuel concentration of the purge gas; and a fuel injection amount calculation device that calculates a final fuel injection amount by reflecting the feedback correction coefficient and the purge correction coefficient on a basic fuel injection amount.

2. The vaporized fuel purge system according to claim 1, further comprising:

a dead band determination device that determines whether the concentration updating base value is out of a dead band;

an update permission device that permits execution of the updating of the fuel concentration of the purge gas only when the concentration updating base value is out of the dead band; and a dead band changing device that, in the sharp-change condition, changes one of an upper threshold value and a lower threshold value of the dead band, which is in a direction in which the concentration updating value is changing, towards the other of the upper and the lower threshold values.

3. The vaporized fuel purge system according to claim 2, wherein the dead band changing device changes, in the sharp-change condition, the other of the upper and the lower threshold values in a same direction as that of the one of the upper and the lower threshold values.

4. The vaporized fuel purge system according to claim 1, wherein the sharp change detection device includes a total purge amount correlation value detection device that detects a total purge amount correlation value correlated with a total purge amount of the vaporized fuel, and the sharp-change condition is detected when the total purge amount correlation value corresponds to a predetermined sharp-change value.

5. The vaporized fuel purge system according to claim 4, further comprising:

an engine temperature correlation value detection device that detects an engine temperature correlation value correlated with a temperature of the internal combustion engine;

a warm start detection device that detects a warm start of the internal combustion engine if the engine temperature correlation value is higher than a reference value upon starting; and a sharp-change condition detection prohibiting device that prohibits the detecting of the sharp change condition when a warm start of the internal combustion engine is detected.

6. The vaporized fuel purge system according to claim 4, further comprising an engine temperature correlation value detection device that detects an engine temperature correlation value correlated with an temperature of the internal combustion engine; and a sharp change condition detection canceling device that cancels the detection of the sharp change condition when the engine temperature correlation value exceeds a reference value.

7. The vaporized fuel purge system according to claim 4, further comprising a sharp change condition detection canceling device that cancels the detection of the sharp change condition when the total purge amount correlation value exceeds a reference value.

8. The vaporized fuel purge system according to claim 1, further comprising an engine temperature correlation value detection device that detects an engine temperature correlation value correlated with a temperature of the internal combustion engine, wherein the fuel concentration updating device includes an initial value setting device that sets an initial value of the fuel concentration of the purge gas higher as the engine temperature correlation value upon start of the internal combustion engine becomes higher.

9. A vaporized fuel purge system, comprising:

a fuel injector that injects fuel in an internal combustion engine;

a vaporized fuel trap that traps fuel vaporized within a fuel tank;

a purge unit that supplies the internal combustion engine with a purge gas containing fuel released from the vaporized fuel trap; and a fuel injection amount calculator that is configured to:

identify a sharp-change period in which a fuel concentration of the purge gas is expected to change sharply during the supplying of the purge gas;

based on a first parameter correlated with a difference between an actual air-fuel ratio of an exhaust gas of the internal combustion engine and a target air-fuel ratio of the exhaust gas, calculate, during the supplying of the purge gas, an updating amount of a second parameter correlated with the fuel concentration of the purge gas, the calculation of the updating amount being performed during the sharp-change period using a calculation method that is different from the one used during other period, so as for the updating amount to be larger during the sharp-change period than during the other period;

update the second parameter by changing it by the calculated updating amount; and calculate a target amount of fuel to be injected from a fuel injector using the first parameter and the second parameter.

10. The vaporized fuel purge system according to claim 9, wherein the fuel injection amount calculator is further configured to:

prohibit the updating of the second parameter when the first parameter is within a predetermined range; and set the predetermined range so as to allow the updating of the second parameter to start earlier during the sharp-change period than during other period.

11. The vaporized fuel purge system according to claim 10, wherein the fuel injection amount calculator is further configured to:

perform the setting of the predetermined range so as to shift, during the sharp-change period, one of an upper end and a lower end of the predetermined range which is in a side toward which the first parameter is expected to change during the sharp-change period, towards an opposite side.

12. The vaporized fuel purge system according to claim 9, wherein the fuel injection amount calculator is further configured to perform the identifying of the sharp-change period based on a time for which the supplying of the purge gas is performed.

13. The vaporized fuel purge system according to claim 9, wherein the fuel injection amount calculator is further configured to:

determine whether the internal combustion engine has been warm-started; and prohibit the identifying of the sharp-change period if the internal combustion engine has been warm-started.

14. A fuel injection amount calculating method for an internal combustion engine to which a purge gas is supplied from a vaporized fuel trap that traps fuel vaporized in a fuel tank, the method comprising:

identifying a sharp-change period in which a fuel concentration of the purge gas is expected to change sharply during the supplying of the purge gas;

based on a first parameter correlated with a difference between an actual air-fuel ratio of an exhaust gas of the internal combustion engine and a target air-fuel ratio of the exhaust gas, calculating, during the supplying of the purge gas, an updating amount of a second parameter correlated with the fuel concentration of the purge gas, the calculation of the updating amount being performed during the sharp-change period using a calculation method that is different from the one used during other period, so as for the updating amount to be larger during the sharp-change period than during the other period;

updating the second parameter by changing it by the calculated updating amount; and calculating a target amount of fuel to be injected from a fuel injector using the first parameter and the second parameter.

15. The method according to claim 14, wherein the updating of the second parameter is prohibited when the first parameter is within a predetermined range; and the predetermined range is set so as to allow the updating of the second parameter to start earlier during the sharp-change period than during other period.

16. The method according to claim 15, wherein the setting of the predetermined range is performed so as to shift, during the sharp-change period, one or both of an upper and a lower end of the predetermined range toward a side that is opposite to a side toward which the first parameter is expected to change during the sharp-change period.

17. The method according to claim 14, wherein the identifying of the sharp-change period is performed based on a time for which the supplying of the purge is performed.

18. The method according to claim 14, wherein the identifying of the sharp-change period is not performed when then internal combustion engine has been warm-started.

* * * * *

UNITED STATES PATENT AND TRADEMARK OFFICE

CERTIFICATE OF CORRECTION

PATENT NO. : 7,305,978 B2
APPLICATION NO. : 11/518308
DATED : December 11, 2007
INVENTOR(S) : Akinori Osanai It is certified that error appears in the above-identified patent and that said Letters Patent is hereby corrected as shown below:

| Column | Line | |
|---|---|---|
| 6 | 1 | After "during" change "other" to --another--. |
| 6 | 22 | After "during" change "other" to --another--. |
| 15 | 59 | Replace "changes" with --change--. |
| 15 | 64 | Change "delays" to --delay--. |
| 16 | 59 | Before "start" insert --the--. |
| 28 | 56 | Change "other" to --another--. |
| 28 | 57 | Delete "as for"; change "to be" to --is--. |

Signed and Sealed this

Twenty-second Day of December, 2009

David J. Kappos

David J. Kappos
*Director of the United States Patent and Trademark Office*